US009435203B2

(12) United States Patent
South

(10) Patent No.: US 9,435,203 B2
(45) Date of Patent: Sep. 6, 2016

(54) ROTARY POSITIVE DISPLACEMENT MACHINE

(75) Inventor: Peter South, North Gower (CA)

(73) Assignee: Peter South (CA)

( * ) Notice: Subject to any disclaimer, the term of this patent is extended or adjusted under 35 U.S.C. 154(b) by 362 days.

(21) Appl. No.: 13/880,183

(22) PCT Filed: Aug. 19, 2011

(86) PCT No.: PCT/CA2011/050507

§ 371 (c)(1),
(2), (4) Date: Apr. 18, 2013

(87) PCT Pub. No.: WO2012/051710

PCT Pub. Date: Apr. 26, 2012

(65) Prior Publication Data

US 2013/0209306 A1 Aug. 15, 2013

Related U.S. Application Data

(60) Provisional application No. 61/405,776, filed on Oct. 22, 2010.

(51) Int. Cl.

| | |
|---|---|
| ***F01C 1/00*** | (2006.01) |
| ***F01C 1/20*** | (2006.01) |
| ***F01C 1/12*** | (2006.01) |
| ***F01C 1/08*** | (2006.01) |
| ***F01C 19/00*** | (2006.01) |
| ***F01C 19/02*** | (2006.01) |
| ***F01D 1/38*** | (2006.01) |

(52) U.S. Cl.

CPC ..... *F01C 1/12* (2013.01); *F01C 1/084* (2013.01); *F01C 1/123* (2013.01); *F01C 19/005* (2013.01); *F01C 19/025* (2013.01); *F01D 1/38* (2013.01)

(58) Field of Classification Search

CPC ..... F01C 1/123; F01C 1/084; F01C 19/025; F01C 1/12

USPC ..... 418/191, 114, 179

See application file for complete search history.

(56) References Cited

U.S. PATENT DOCUMENTS

| | | | | | |
|---|---|---|---|---|---|
| 1,426,820 | A | | 8/1922 | Crawford | |
| 1,923,500 | A | | 8/1933 | Northey | |
| 2,058,817 | A | | 10/1936 | Northey | |
| 2,908,257 | A | * | 10/1959 | Congard | 123/246 |
| 3,392,676 | A | | 7/1968 | Bizier | |
| 3,453,992 | A | | 7/1969 | Graham | |
| 3,472,445 | A | * | 10/1969 | Brown | 418/189 |
| 3,535,060 | A | * | 10/1970 | Brown | 418/114 |
| 3,723,031 | A | | 3/1973 | Brown | |
| 3,862,543 | A | * | 1/1975 | Spinnett | F01C 1/20 418/196 |
| 3,923,014 | A | | 12/1975 | Knickerbocker | |

(Continued)

FOREIGN PATENT DOCUMENTS

| | | |
|---|---|---|
| CA | 1119139 | 3/1982 |
| CA | 2596603 A1 | 8/2006 |

*Primary Examiner* — Kenneth Bomberg
*Assistant Examiner* — Anthony Ayala Delgado
(74) *Attorney, Agent, or Firm* — Banner & Witcoff, Ltd.

(57) ABSTRACT

Rotary displacement machines are known for their uses as compressors, expansion engines and the like. Many comprise two or more rotors mounted for simultaneous rotation within a casing, with intermeshing or interengagement of lobes and pits as surface features of the rotors, thereby to handle a working fluid. Disclosed herein are rotary displacement machines with improved structures and rotor configurations.

8 Claims, 20 Drawing Sheets

(56) References Cited

U.S. PATENT DOCUMENTS

| | | | | |
|---|---|---|---|---|
| 4,021,903 | A | 5/1977 | Walsh | |
| 4,078,526 | A | 3/1978 | Gail | |
| 4,086,880 | A | 5/1978 | Bates | |
| 4,138,848 | A * | 2/1979 | Bates | F01C 1/20 418/122 |
| 4,145,168 | A | 3/1979 | Smith, Jr. et al. | |
| 4,224,016 | A | 9/1980 | Brown | |
| 4,236,496 | A | 12/1980 | Brownfield | |
| 4,321,897 | A | 3/1982 | Pelekis | |
| 4,324,538 | A | 4/1982 | Brown | |
| 4,406,601 | A | 9/1983 | Towner | |
| 4,430,050 | A | 2/1984 | Blazejewski | |
| 4,432,314 | A | 2/1984 | Pelekis | |
| 4,646,693 | A | 3/1987 | Fayngersh et al. | |
| 4,761,125 | A | 8/1988 | Inagaki et al. | |
| 4,907,954 | A | 3/1990 | Slupski | |
| 4,971,002 | A | 11/1990 | Le | |
| 5,039,289 | A | 8/1991 | Eiermann et al. | |
| 5,066,205 | A | 11/1991 | Ingalls | |
| 5,149,256 | A | 9/1992 | Schmitz | |
| 5,154,149 | A | 10/1992 | Turner | |
| 5,329,900 | A | 7/1994 | Dye | |
| 5,357,923 | A | 10/1994 | Osterburg et al. | |
| 6,079,386 | A | 6/2000 | Barker et al. | |
| 6,176,695 | B1 | 1/2001 | Dye | |
| 6,273,055 | B1 | 8/2001 | White | |
| 6,302,079 | B1 | 10/2001 | Beal | |
| 6,481,410 | B1 | 11/2002 | Ogilvie | |
| 6,776,594 | B1 | 8/2004 | Heng-I et al. | |
| 6,988,482 | B2 | 1/2006 | Lockett | |
| 7,255,545 | B2 | 8/2007 | Tien-Tung et al. | |
| 7,341,042 | B1 | 3/2008 | Chung et al. | |
| 7,553,143 | B2 | 6/2009 | Yang et al. | |
| 7,562,450 | B2 | 7/2009 | Chung et al. | |
| 7,565,741 | B2 | 7/2009 | Tien-Tung et al. | |
| 7,565,742 | B2 | 7/2009 | Tien-Tung et al. | |
| 7,594,323 | B2 | 9/2009 | Chung et al. | |

* cited by examiner

MINIMUM PERMISSIBLE LENGTH FOR L

K = (N+1)/(N*(COS(T)+SIN(T)*COS(N*T)/SIN(N*T)))

L = K*N*SIN(T)/SIN(N*T)

ROTARY POSITIVE DISPLACEMENT MACHINE

RELATED APPLICATION DATA

This application is a National Stage Application under 35 U.S.C. 371 of co-pending PCT application PCT/CA2011/050507 designating the United States and filed Aug. 19, 2011; which claims the benefit of U.S. provisional patent application No. 61/405,776 and filed Oct. 22, 2010 each of which are hereby incorporated by reference in their entireties.

FIELD OF THE INVENTION

The invention relates to the field of rotary positive displacement machines for handling a working fluid such as a liquid or gas, and to machines useful as compressors or expanders or the like. The invention also relates to the field of rotary expansion engines, such as for example heat engines and those involving internal or external combustion. In particular the invention relates to such rotary devices comprising interengaging lobed rotors adapted to handle a fluid.

BACKGROUND TO THE INVENTION

A large variety of rotor mechanisms are known in the art as exemplified by U.S. Pat. Nos. 1,426,820, 4,138,848, 4,224,016, 4,324,538, 4,406,601, 4,430,050 and 5,149,256, incorporated herein by reference. Typically, the machines comprise two or more rotors with substantially parallel axes of rotation, with each rotor comprising a cylindrical portion and one or more lobe and pit combinations. The rotors are typically located within bores of a casing with the lobe tips in close proximity or in a sealing relationship with internal surfaces of the bores at different stages of each rotary cycle, or with the lobe tips or surfaces in close proximity or sealing relationship with a surface of a pit of an adjacent rotor, depending upon a position of the rotor in the rotary cycle. As adjacent rotors rotate about their central axes in opposite directions, the lobes and pits of the adjacent rotors interengage or mesh so as to achieve movement and/or pressurization of fluid located in chambers formed temporarily between the lobes and other surfaces of the rotors during each rotary cycle. Thus, if the rotary machine is used as a compressor or pump the fluid under pressure may be caused to exit the chambers via high pressure outlets. Alternatively, such rotary machines may be used as heat or expansion engines. For example, heating of fluid within the chambers may cause an increase in pressure or expansion of the fluid within the chambers resulting in movement of the rotors about their central axes.

Heat can also be added to the compressed working fluid in a place that is external to the rotors. The added heat increases the volume and/or pressure of the working fluid to further facilitate movement of the rotors.

Over many years, efforts have been made to improve the efficiency of rotary machines by adjusting the size, shape and configuration of the rotors and their respective lobe and pit arrangements. These efforts are illustrated by numerous examples in the prior art of different rotor configurations, with rotors comprising one or multiple lobes, or with adjacent rotors in the same machine comprising different configurations. Often, such efforts have given rise to increasingly complex rotor configurations and pit/lob design principles. However, rotor designs still present a significant challenge. It can be difficult to achieve proper sealing between the surfaces of the moving rotors as well as the internal surfaces of their respective bores during each part of the rotary cycle. Sometimes, the lobes and lobe tips of adjacent rotors may not mesh completely with one another. Consequently, poor sealing between the rotors may reduce the efficiency of the machine and cause an increase in vibration or noise during operation of the machine. Moreover, inappropriate intermeshing between the rotors may increase wear and thus reduce the durability of the machine.

Thus, there remains a continuing need for rotary displacement machines that are improved compared to those of the prior art, in that they exhibit at least one improved property selected from: increased efficiency, increased durability, and reduced noise or vibration.

SUMMARY OF THE INVENTION

It is one object of the present invention, at least in preferred embodiments, to provide a rotary displacement machine.

Certain exemplary embodiments provide for a rotary, positive displacement machine, with interengaging rotors, adapted to handle a working fluid by rotation of the rotors through rotary cycles, the machine comprising:

- a casing structure comprising two or more intersecting bores, at least two of which bores have different radial dimensions relative to one another, the casing further including at least one high pressure port for the flow therethrough of working fluid at high pressure, and at least one low pressure port for the flow therethrough of the working fluid at lower pressure;
- rotors, each mounted for rotation in one of said intersecting bores with axes for rotation substantially parallel with one another, each rotor comprising at least one radially extending lobe having peripheral, radially-extended surfaces which define close-clearance or sealing interfaces with inner surfaces of each bore within which each rotor is mounted for rotation;
- such that each lobe on each rotor mounted in one size of said bores has lobes that have a smaller radial extent measured from the hub of its respective rotor to a farthest extremity of the lobe, compared to a larger radial extent of each lobe on each rotor mounted in the other size of said bores, thus to provide said close-clearance or sealing interfaces, each rotor also comprising at least one pit into which to receive a lobe of an adjacent rotor during an interengaging portion of each rotary cycle;
- and
- timing gear means constraining said rotors to rotate in timed, interengaging relation in said intersecting bores, with adjacent rotors rotating in opposite directions such that the lobes and pits of adjacent rotors interengage as the rotors rotate.

Optionally, the machine is a compressor and the rotation of at least one of said rotors is driven by a power source, with resulting working fluid under pressure exiting the machine at the high-pressure port.

Optionally, the machine is an expansion engine, and the rotation of the rotors is driven by controlled input of working fluid at the high-pressure port.

In some embodiments each lobe on of each rotor comprises a convex surface with a profile similar to the inner surface of its respective bore, thereby to provide said close-clearance or sealing interface when each lobe moves adjacent the inner surface of its respective bore during each rotary cycle.

In certain exemplary embodiments each lobe on each rotor mounted in each of the said other bores that are suitably dimensioned comprises peripheral, radially extending surfaces that extend further from its hub, compared to the lobe or lobes of each rotor mounted in each said first bore, and wherein each lobe of each rotor mounted in said other bore has a lobe-tip that is blunt-ended or 'trimmed' to achieve, when the lobe is moving adjacent a pit of an adjacent rotor during a rotary cycle, a close-clearance or sealing relationship with surfaces of said pit of the adjacent rotor.

Optionally, the high pressure port is located on an end-plate of the casing.

Alternatively, in some embodiments, the high pressure port is formed transiently during each rotary cycle by alignment of an orifice extending through a rotor having lobes with the smaller radial extent, from a central portion thereof to a pit thereof, and an orifice in a conduit fixed from rotation and extending co-axially with that rotor.

Optionally, in selected embodiments, the rotors comprise a central rotor (which may have lobes with either the larger or the smaller extent), and at least two other rotors that have lobes with the other radial extent spaced appropriately from one another about the central rotor.

Further exemplary embodiment provide for a compressor for a fluid, the compressor comprising the rotary positive displacement machine as described herein, wherein at least one of the rotors is powered for rotation by a drive means, said timing gear means transferring rotational energy to the other rotor(s) if necessary, and/or timing the movement of the other rotor(s) relative to the driven rotor(s), so that adjacent rotors rotate and a lobe of a rotor having the lobes with the larger radial extent mounted for rotation in an appropriate bore is forced into a close-clearance or sealing relationship with a concave surface of a pit of at least one adjacent rotor that has lobes with the smaller radial extent mounted for rotation in a suitable bore, thereby to cause pressurization or compression of the fluid therebetween.

Optionally, the pressurized or compressed fluid therebetween exits the compressor under pressure through the high pressure port. Optionally, the high pressure port is formed transiently during each rotary cycle by alignment of an orifice extending between a central portion and a pit of each rotor having the smaller lobes and mounted for rotation in a suitable bore, and an orifice in an output conduit fixed from rotation and extending co-axially with that rotor.

Further exemplary embodiments provide for an expansion engine comprising the rotary positive displacement machine as described herein, wherein fluid is forced into the machine at high pressure via the high pressure port to force apart the lobes of adjacent rotors thereby to cause rotation of the adjacent rotors in opposite directions. Optionally, the high pressure port extends through the casing of the expansion engine. Optionally, the high pressure port is formed transiently during each rotary cycle by alignment of an orifice extending between a central portion and a pit of a rotor with the lobes having the smaller radial extent that is mounted for rotation in a suitable bore, and an orifice in an input conduit fixed from rotation and extending to said central portion of that rotor, whereupon each alignment during each rotary cycle, the fluid is injected under pressure through the high pressure port, and into a space between a lobe of an adjacent rotor that has lobes with the larger radial extent and mounted for rotation in a suitable bore, and a pit of the rotor that has the lobes with the smaller radial extent and is mounted for rotation in a suitable bore.

In further exemplary embodiments of the expansion engine, each lobe(s) of each rotor that has the lobes with the larger radial extent and is mounted for rotation in a suitable bore is blunt-ended or 'trimmed' to provide an increased surface area of close-contact or sealing between each lobe and the pit of the adjacent rotor when the fluid is forced into the space. Optionally, the rotors rotate multiple times by the repeated or continuous injection of fluid under pressure through the high pressure port upon each rotary cycle of the machine. Optionally, the fluid is pressurized or expanded prior to entry into the engine by heating.

In still further exemplary embodiments there is provided a gas turbine engine comprising the rotary positive displacement machine as described herein, the high pressure port comprising an injector for injecting a combustible fuel or fuel/air mixture, into the engine wherein ignition of the injected fuel causes rapid heating and increase in volume and/or pressure of the fluid within the casing to force the lobes of adjacent rotors apart, thereby to turn adjacent rotors in opposite directions.

Optionally, each injector of the gas turbine engine is located to inject fuel into a space formed during a rotary cycle between a pit of a rotor that has the lobes with the smaller radial extent and is mounted for rotation in a suitable bore, and a trailing edge of a lobe of an adjacent rotor that has the lobes with the larger radial extent and is mounted for rotation in a suitable bore, so that ignition of the injected fuel causes rapid heating and an increase in volume and/or pressure of the fluid within the space to force the lobes of the adjacent rotors apart, thereby to turn the adjacent rotors in opposite directions.

Optionally, the lobe(s) of each rotor of the gas turbine engine that has the lobes with the larger radial extent and is mounted for rotation in a suitable bore are blunt-ended or 'trimmed' to provide an increased surface area of close-contact or sealing between each of said lobe(s), and a pit of an adjacent rotor when the fuel is injected into the space and ignited.

Optionally, the gas turbine engine described herein may comprise ignition means to ignite the fuel upon or following injection into the casing. Optionally, the engine may further comprise, as an initial processing stage for the fuel, a compressor stage comprising a compressor as described herein to pressurize or compress the fuel prior to injection of the fuel into the casing for ignition, such that pressurized or compressed fluid leaving the compressor via the high pressure port thereof is subsequently injected for ignition to drive the engine. Optionally, the rotation of the rotors of the compressor stage is driven by rotational energy derived from the rotation of the rotors of the engine.

In further exemplary embodiment of the gas turbine engine, at least one rotor of the compressor stage is connected to at least one rotor of the engine via a drive shaft.

In further exemplary embodiments. There is provided a gas turbine engine comprising the rotary positive displacement machine as described herein as a compressor. Optionally, the gas turbine engine is connected to a compressor comprising another rotary positive displacement machine as described herein, wherein compressed working fluid from the compressor is fed or injected into the engine for ignition. Optionally, the compressed working fluid is heated prior to being fed or injected into the engine.

DEFINITIONS

Figure 1:
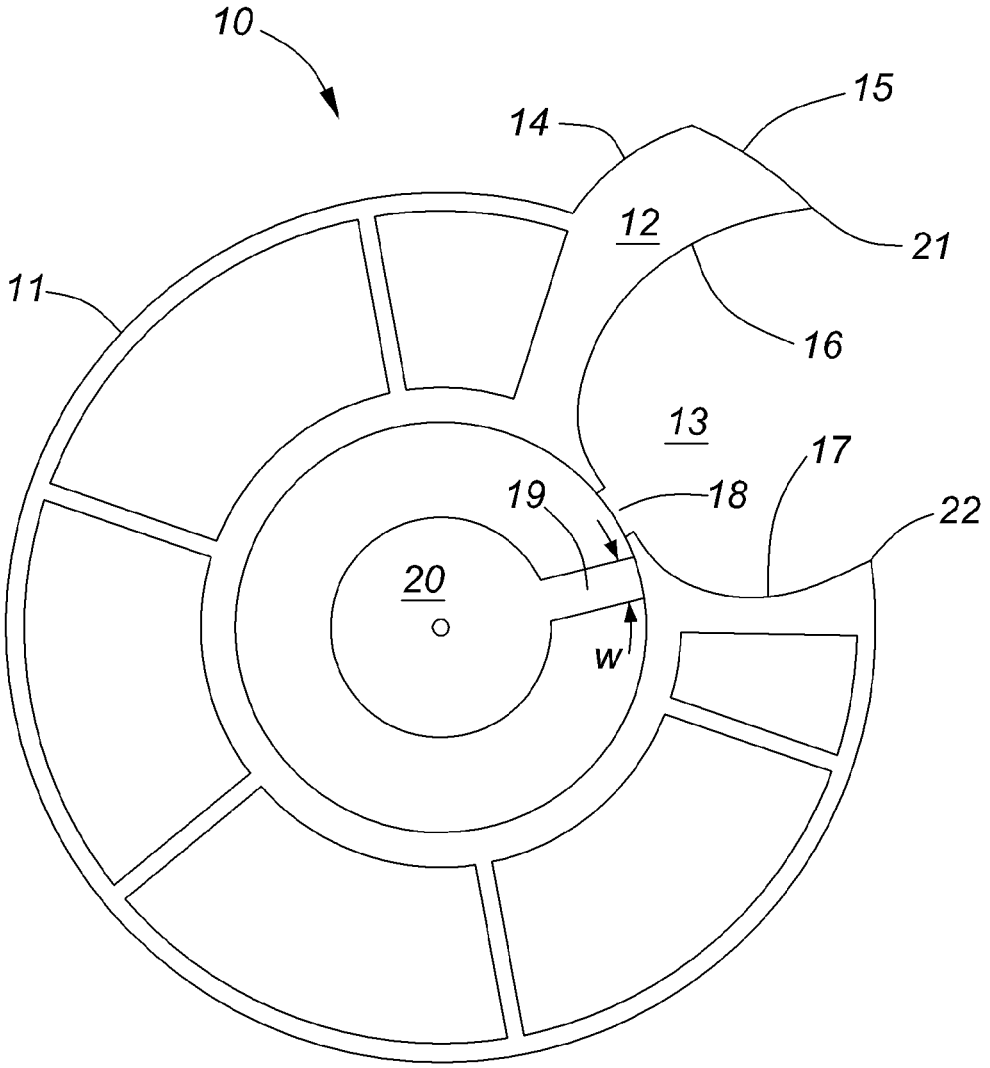
FIG. 1 illustrates an end-on cross-sectional view of one example of a rotor for use with a rotary positive displacement machine disclosed herein. This example illustrates a rotor comprising a lobe having a smaller radial extent when measured from a hub to lobe tip.

Fluid: refers to either any one of a gas, gas mixture, liquid, liquid mixture, gas containing vapour, gas containing combustions products and any other fluid.

Radial extent: refers to the distance that a lobe of a rotor extends from a distance measured from the hub of the rotor to a farthest extremity of the lobe therefrom, extending radially from the axis. Typically, the distance measures is as a straight line for the shortest distance from the hub to the farthest extremity as per FIG. 2 and the description thereof.

Rotary cycle: refers to one rotation of a rotor or one rotation of adjacent rotors in a rotary positive displacement machine as described herein.

DETAILED DESCRIPTION OF THE INVENTION

Rotary displacement machines of numerous types and configurations are known in the art. Typically, such machines are used to compress fluid materials or, when operated in a reverse manner, can function as rotary expansion engines. Through significant ingenuity, the inventor has developed rotary displacement machines with alternative configurations or relative dimensions compared to those previously known, which give rise to significant and unexpected advantages, as will become apparent from the foregoing.

In selected embodiments the rotary displacement machines disclosed herein employ rotors that are mounted for rotation within a casing comprising intersecting bores, wherein at least two of the bores (or the two bores if only two are present) have different relative sizes or diameters, and the rotors include lobes dimensioned accordingly. Unexpectedly, such features, optionally together with additional features related to the rotor or bore configurations, provide for rotary displacement machines that are more efficient, or more durable, or which may operate with less noise/vibrations compared to others known in the art.

It may be noted that the rotary positive displacement machines disclosed herein are suitable for use in any application in which rotary displacement machines of the prior art are used, including but not limited to a compressor, a generator, a rotary engine, a shaft turbine, a prop jet and any other similar devices that are known in the art. A skilled person will appreciate the general manner, configuration and set up for which rotary positive displacement machines may be utilized in accordance with such applications.

The inventor has given detailed consideration to the stages of a rotary cycle of a rotary displacement machine, wherein one rotary cycle refers to one revolution of the interengaging single or multiple lobed rotors, and in particular the interfacing between lobes (or projections/teeth/radial extensions) and the pits (or cusps/grooves/recesses) of adjacent rotors during the cycle. Moreover, the inventor has given detailed consideration to the various stages of a rotary cycle, including the interaction of these portions of the rotors with one another, and with internal surfaces of the respective bores. The transition of the rotors between these various stages of a rotary cycle has also been taken into consideration.

Turning first to FIG. 1 there is shown a rotor shown generally at 10 for use in accordance with an example embodiment, illustrated in cross-section. Typically, though not necessarily, the rotors described herein have a uniform cross-section when taken across an angle perpendicular to the axis of rotation. The rotor has a mainly circular cross-section, corresponding to a cylindrical hub 11, with the exception of adjacent lobe 12 and pit 13 regions shaped for close or sealing interaction with an adjacent rotor (not shown). In this example, the rotor includes only one lobe and pit combination. However, the invention is not limited in this regard, and more than one or even several lobes and pits may be present on each rotor. In FIG. 1 the lobe 12 comprises a region of the rotor that projects radially from the main circular cross-section of hub 11, and which in this embodiment lobe 12 includes curved surfaces 14, 15, 16 described in more detail below.

Sliding contact surface 14 (which in operation has sliding contact with point 38 in FIG. 2) defines a side of the lobe opposite pit 13, whereas outer curved surface 15 is shaped to provide a close clearance or sealing surface when, in operation, the lobe moves adjacent an inner surface of the rotor's respective bore. Sliding contact surface 16 defines another side of lobe 12. This sliding contact surface has contours that are optionally defined in accordance with FIG. 3 and extends from sharp tip 21 and to form the pit 13. This pit is also defined by sliding contact surface 17. Curve 17, together with point 22, provide a sealing relationship against surface 34 in FIG. 2. Optional ports 18, 19 are also shown, with port 18 extending from a central region of the rotor to a surface of the rotor at pit 13, whereas port 19 extends from input/output conduit 20, which may be fixed from rotation. When the rotation of rotor 10 results in temporary alignment of ports 18 and 19, this may result in fluid contact between the lumen of the input/output conduit 20 and an interior lumen of the bore in which the rotor is mounted, thus permitting inflow or outflow of the fluid, for example under pressure.

Figure 2:
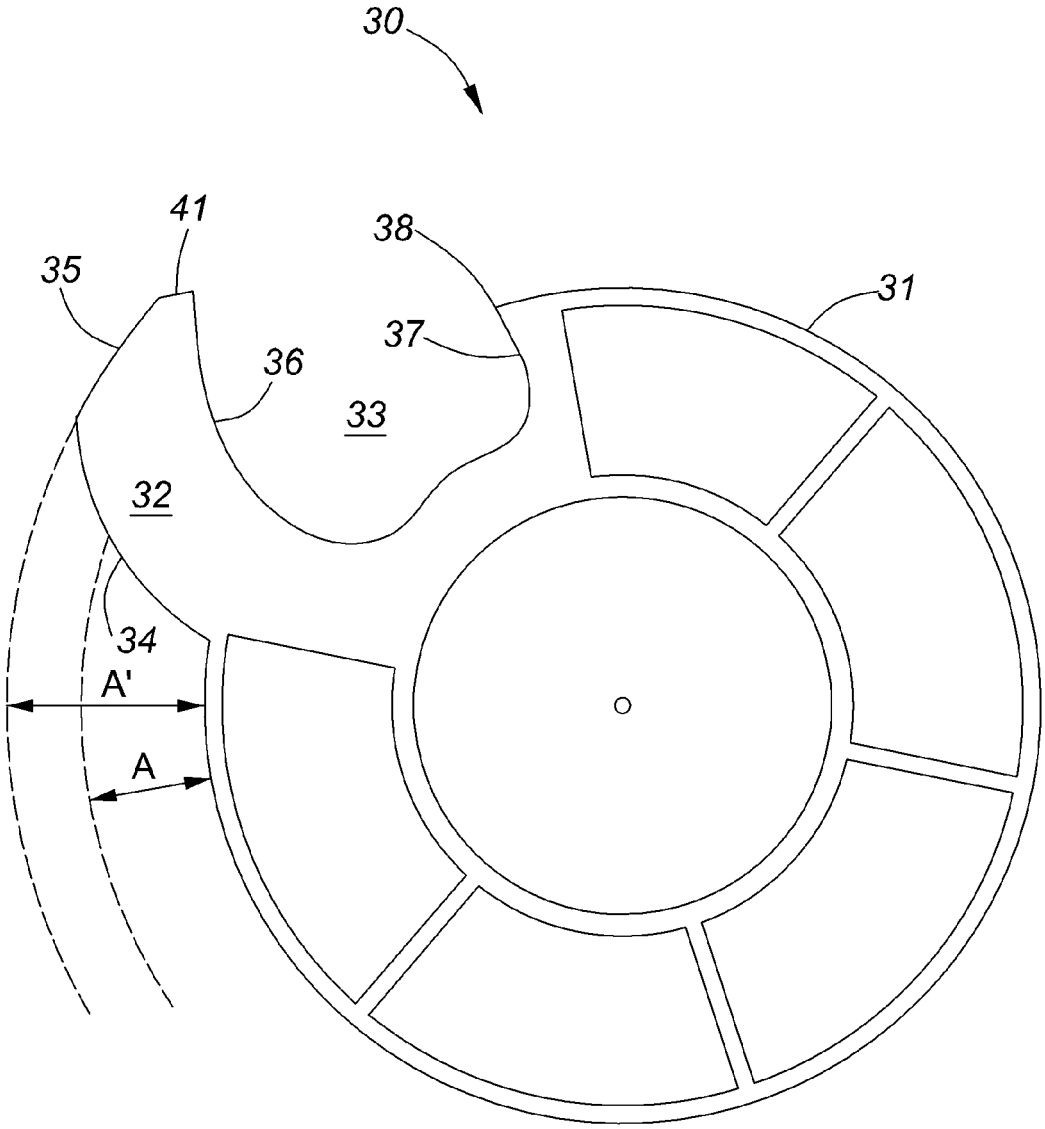
FIG. 2 illustrates an end-on cross-sectional view of one example of a rotor for use with a rotary positive displacement machine disclosed herein. This example illustrates a rotor comprising a lobe having a larger radial extent when measured from a hub to lobe tip.

FIG. 2 illustrates another rotor for use in conjunction with the rotary displacement machines disclosed herein. The rotor is intended for use together with the rotor of FIG. 1 in the same machine, and in adjacent bores. The rotor of FIG. 2 has a configuration similar to that shown in FIG. 1, with some important differences. The rotor shown generally at 30 includes hub 31, lobe 32 and pit 33. However, importantly lobe 32 has a greater radial extent than that of lobe 12. The comparison of dimensions A and A' shows that difference, wherein dimension A is the length or maximum radial extent of lobe 12 illustrated in FIG. 1 (extending from the hub of the rotor to the farthest extremity of lobe 12), and dimension A' is the comparable length or maximum radial extent of lobe 32 illustrated in FIG. 2. In accordance with various embodiments, the invention encompasses any machines in which distances A and A' are different from one another, regardless of the degree of difference.

The depth of the pit 33 from the outer edge of the hub is less than that of pit 13 and hence the distance from the base of the pit to the tip of the lobe is essentially the same for both rotors. The clearance surface 36 is required to allow the sharp tip 21 of the other rotor to pass by without contact. The contours of curved clearance surface 36 may optionally be calculated in accordance with FIG. 3. Also illustrated in FIG. 2 is a preferred feature by way of the trimmed lobe tip 41. In typical rotors for use in rotary positive displacement machines, sharp lobe tips are typically present at the interface between the outermost portion of the lobe and the sliding contact surface forming one side of pit 13. The end of the lobe 41 is trimmed to the specifications given for example in FIGS. 3 and 4. The contour of the trimmed surface will correspond to the contour of the sliding contact surface 16 of the lobe 12 in FIG. 1 and provide a close-clearance or sealing relationship during the portion of the cycle when they are in close proximity. This relationship is superior to that created by a sharp pointed tip. The trimmed tip is in contrast to the sharp tip 21 that is present on the rotor in FIG. 1. The curved surface 37 provides clearance and/or sealing for sliding contact surface 14. (The combination of curved surfaces 14 and 37, as well as the combination of curved surfaces 17 and 34, can optionally be replaced by appropriate involute curves.) Further the base(s) of the pit(s) in this rotor can be used as the location for input/exhaust ports for the compressor/motor.

Figure 3:
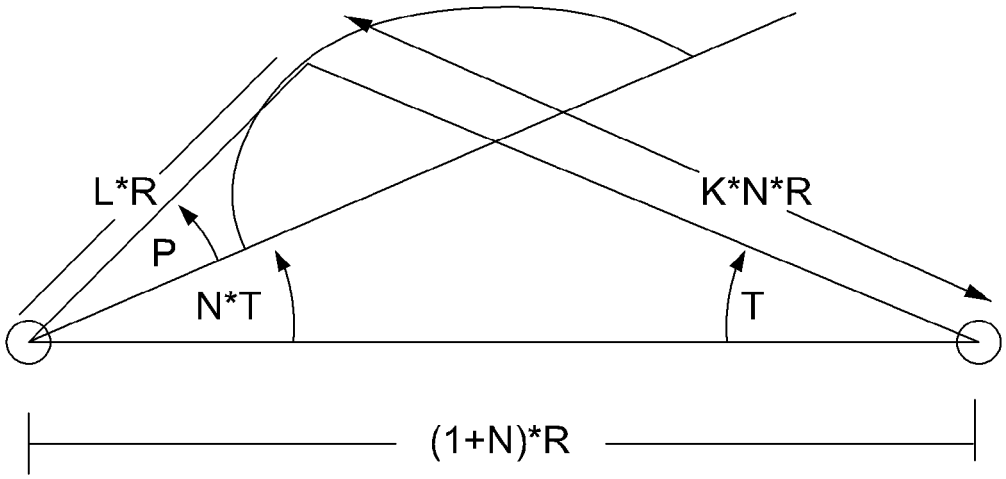
FIG. 3 illustrates one way to calculate the shape of the sliding contact surface.

FIG. 3 provides one example means to calculate the shape of the sliding contact or clearance surface. Fixed points on one rotor that are at a distance K*N*R (where R is the hub radius of the rotor, N is the ratio of the hub radii when compared with that of the interengaged rotor, and K refers to a distance from the axis of the hub/rotor to a prominent point on the lobe of the rotor, which may be but is not necessarily the tip of the lobe) from the axis of rotation will contact the other rotor that is constrained to rotate in the opposite direction at a speed that is N times as great as that of the first rotor. Points on the sliding contact surface will be defined by length L and the angle P from an origin that is fixed to that rotor.

Figure 4A:
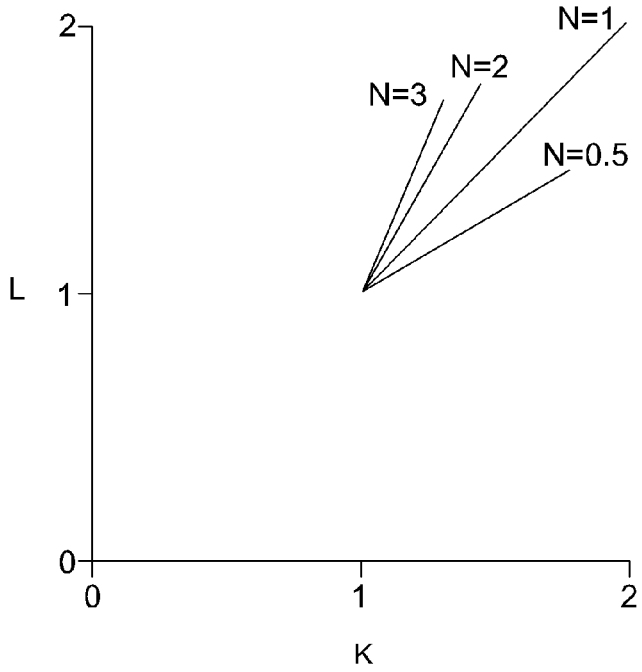
FIG. 4*a* illustrates a graph of K (x-axis) v. L (y-axis) and corresponding calculation shown in FIG. 4*b*.
Figure 4A:
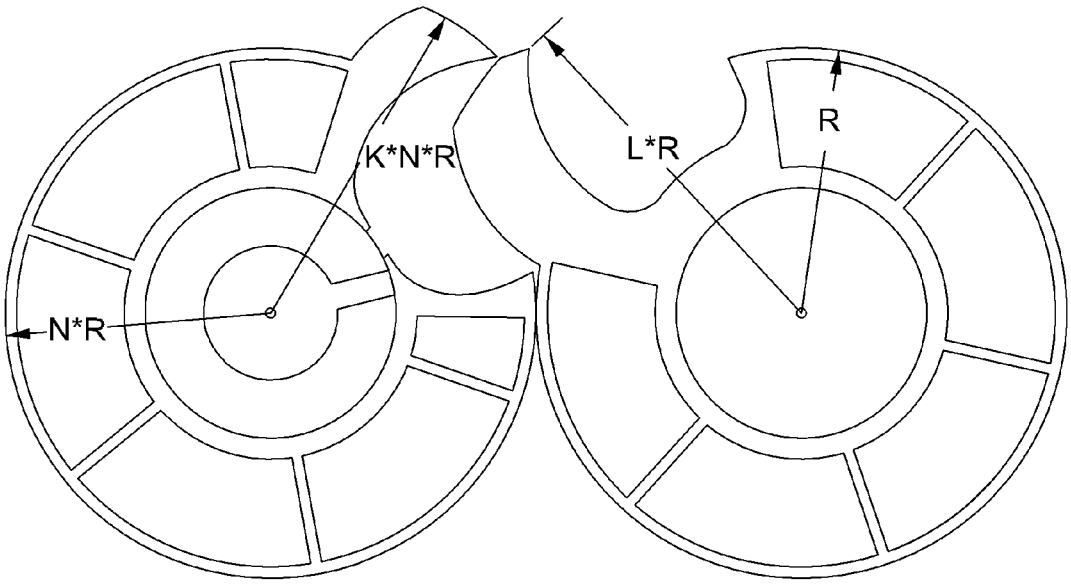
Figure 4B:
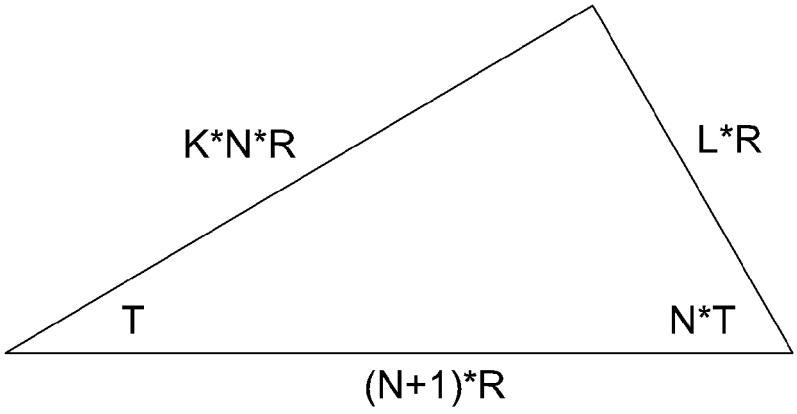
FIG. 4 provides graphs to illustrate the minimum allowable distance from the axis of a rotor with a lobe having a larger radial extent for use in an appropriate bore of a rotary positive displacement machine as described herein, to the trimmed tip of its respective lobe (L being the ratio compared to the general radius R of the rotor portions that do not include a lobe or pit). The distance is shown as a function of the radius of the tip of the lobe on the rotor for a range of ratios of the radii of the rotor L when compared to that K for an adjacent rotor (that has lobes with a smaller radial extent when measured from the hub to an outmost extremity of its respective lobe).
FIG. 4*c* illustrates a graph of K (x-axis) v. (L−1)/((K−1)*N) (y-axis).
Figure 4C:
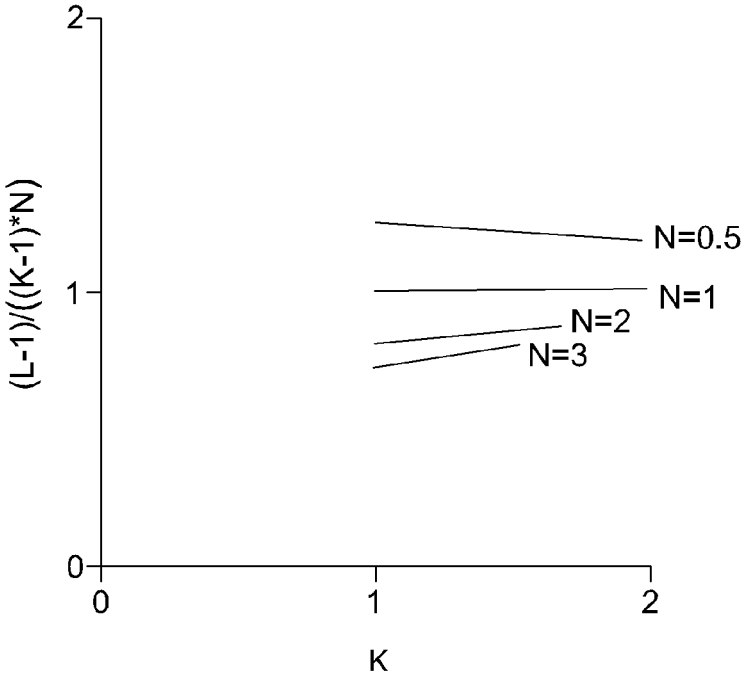
Figure 4C:
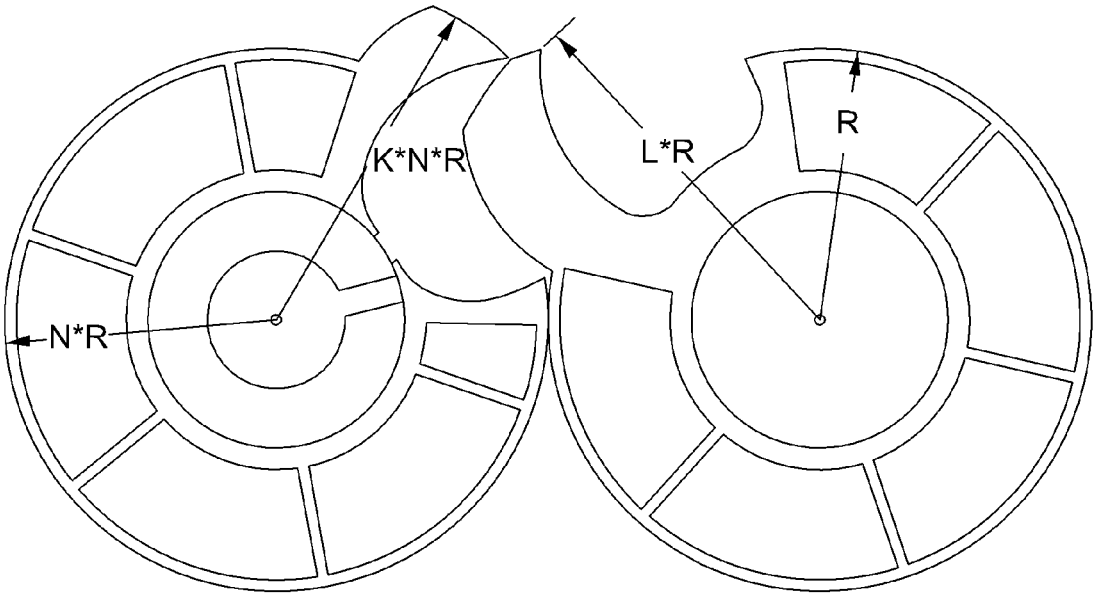

FIG. 4*a* provides a graph to show the minimum permissible distance from the rotor axis to the innermost point of the trimmed tip of the lobe of a rotor with the lobe having the greater radial extent. The Y-axis shows the minimum permissible length of L compared to K for a number of different values of N (where N is the ratio of the hub radius of the rotor with lobes having a smaller radial extent when compared with the hub radius of the rotor having lobes with the larger radial extent (e.g. as per the calculation shown in FIG. 4*b*). Also shown in FIG. 4*c* is a graph to illustrate the minimum allowable length for L for a range of N and K, with the Y axis indicating values for (L−1)/((K−1)*N) and the X axis indicating values for K. The results illustrated are non-limiting and for illustrative purposes only. The graphs indicate that the permissible amount of trim is a function of the lobe-tip radius to hub radius ratio of the rotor having the lobe with the smaller radial extent and also the ratio of the hub radii of the two rotors.

In accordance with previous discussions, in selected embodiments in which only two rotors are used and each rotor has the same number of lobes, (the rotor with the lobes having the smaller radial extent will then also have the smaller overall diameter) a first rotor may be mounted for rotation in a first bore, which is smaller in diameter than an adjacent larger bore, and one other rotor may be mounted for rotation in the other larger bore. The rotors each have at least one radially extending lobe and at least one pit, with axes of rotation substantially parallel with one another, so that simultaneous rotation of the rotors in adjacent bores in opposite direction results in intermeshing of the lobes and pits of the rotors as they rotate. In other selected embodiments, the first rotor may be designated as the "primary" rotor, while the other rotor may be designated as the "secondary" rotor. However, when more than two rotors are used, the primary rotor must have at least as many lobes as the number of rotors that interengage with it, in order to maintain the maximum efficiency. The primary rotor may have the shorter (less radial extent) lobes that have a radial extent equal to K*N*R as defined for example in FIG. 4 and the rotor might have a greater total radius than a secondary rotor or rotors if it has more lobes than the secondary rotors. Each of the secondary rotors will have lobes of the larger radial extent that are trimmed in accordance with the information given for example in FIG. 4 and each rotor may be similar to one another. For maximum efficiency the secondary rotors may have a minimum angular spacing that is equal to the angular lobe spacing on the primary rotor. In still further embodiments, the rotary positive displacement machines disclosed herein may comprise one rotor (with one or more lobes of a larger radial extent that are trimmed as shown for example in FIG. 2) in an appropriate bore and two or more rotors with one or more lobes that have a smaller radial extent (as illustrated for example in FIG. 1) and in appropriately sized bores arranged around it. Thus, certain embodiments encompass the use of a primary rotor as per FIG. 2 with secondary rotors as per FIG. 1 arranged about the primary rotor, with corresponding lobe and pit combinations for intermeshing relationships as the rotors rotate. In still further embodiments, when the secondary rotors have two or more lobe/pit combinations each or any of the secondary rotors may be interengaged with another primary rotor.

Specific design of the primary and secondary rotors, and the number of lobe/pit combinations present on each of the rotors, will be dependent upon the machine design requirements to ensure proper intermeshing of all lobes and pits of the secondary, surrounding rotors with the lobes and pits of the primary, central rotor, as the machine cycles.

Figure 5:
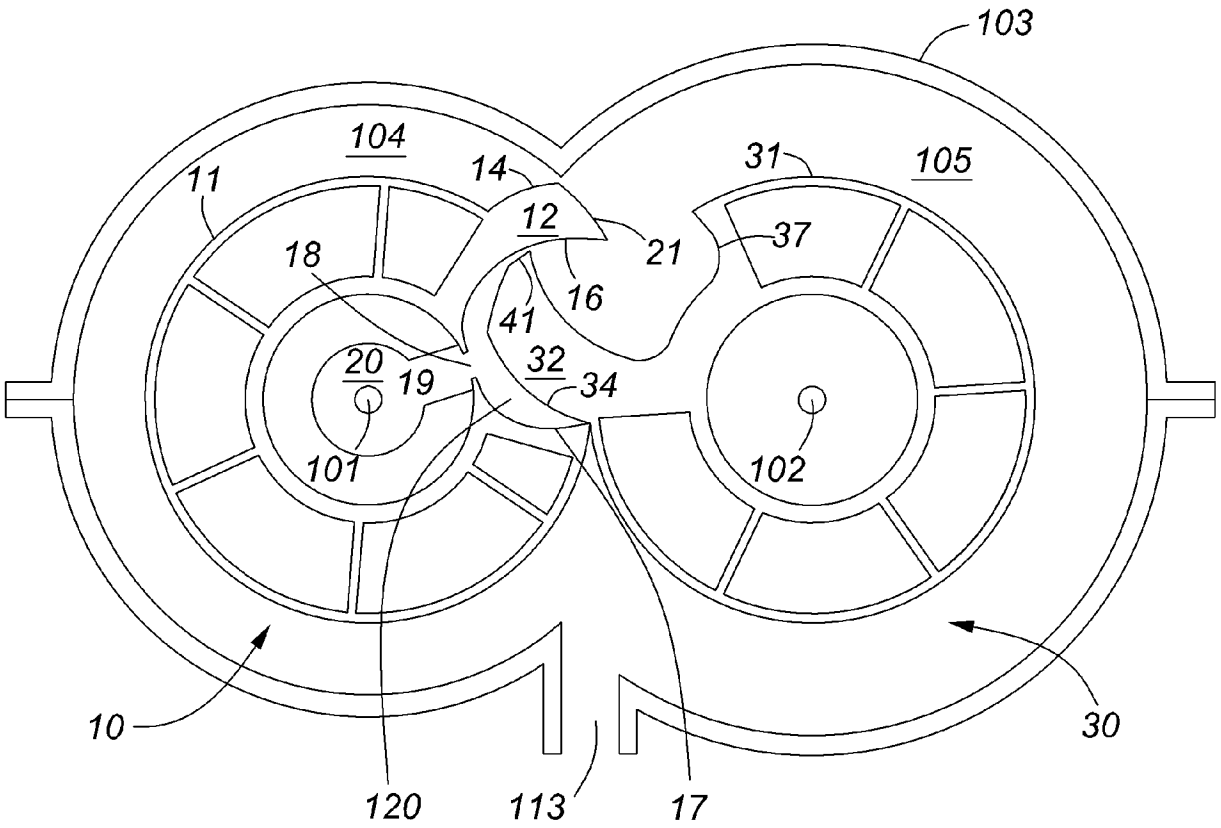
FIG. 5 illustrates an end-on cross-sectional view of one example of a rotary positive displacement machine as disclosed herein.

FIG. 5 illustrates a cross-sectional view of a rotary positive displacement machine according to one exemplary embodiment, which employs the rotors shown in FIGS. 1 and 2 in an interengaging or intermeshing relationship: shown generally at 10 and 30. The rotors are mounted via spindles 101, 102 within casing 103 having two intersecting bores 104, 105 dimensioned such that upon rotation of the rotors the lobes 12, 32 have a close-clearance or sealing relationship with the inner surfaces of bores 104, 105. The rotors are fixed for simultaneous rotation in opposite directions via a timing gear means 110 (not shown in FIG. 5, but illustrated schematically in FIG. 9) such that regardless of the direction of rotation of the rotors the lobes 12, 32 move to form an interengaging relationship with their tips and curved surfaces moving in a close-clearance or sealing relationship. The trimmed tip 41 is shown in a close-clearance or sealing relationship with sliding surface 16.

Figure 6:
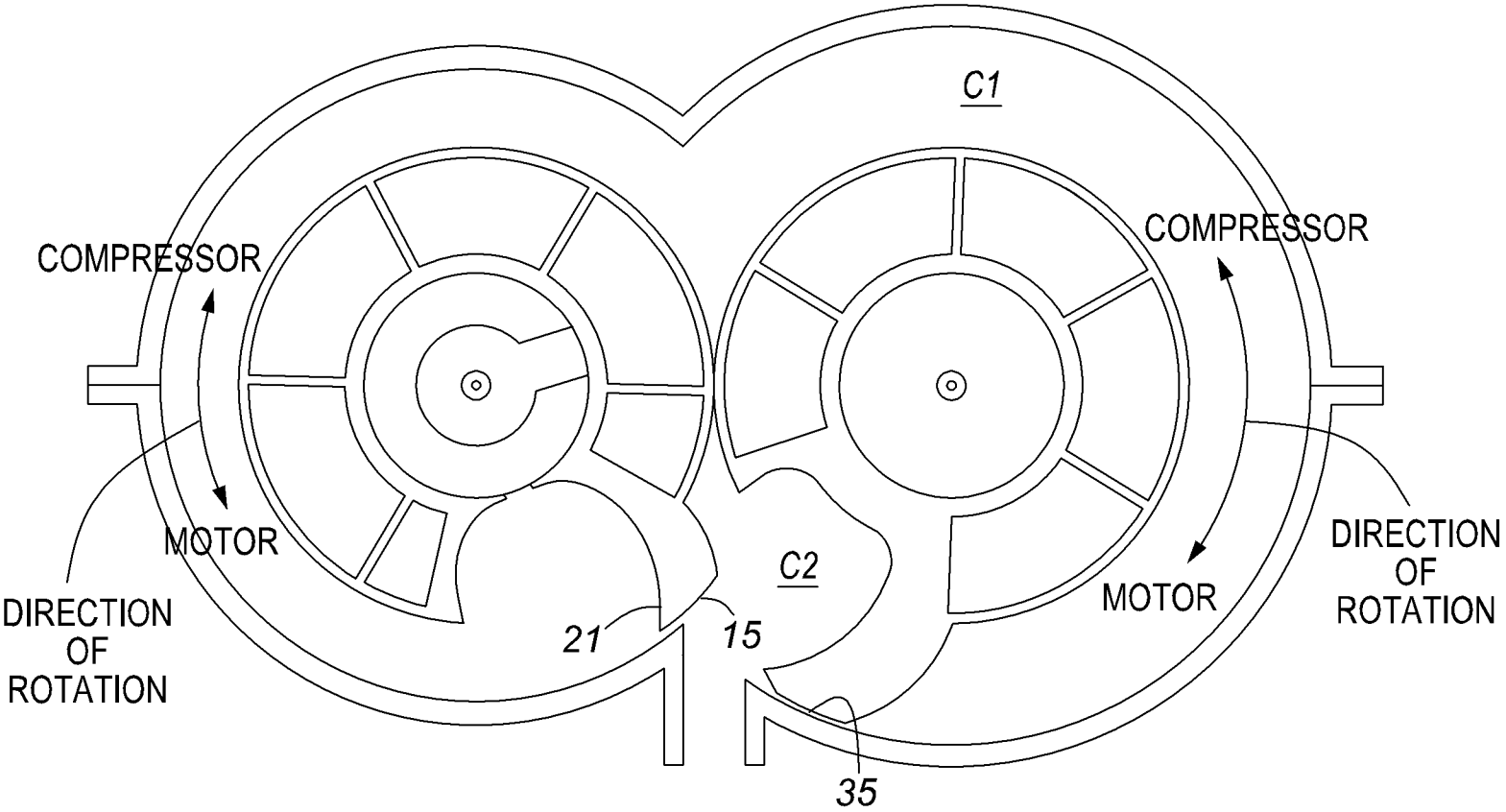
FIG. 6 Illustrates a position of the rotors in the casing at the start of a compression/intake cycle for the compressor or the end of the expansion/exhaust cycle for a motor.

FIG. 6 shows an example of the position of the two rotors at the start of the compression/intake cycle for a compressor or the end of the expansion/exhaust cycle for a motor. Once the cavity C1 is sealed by the surfaces 15 and 35 being in a sealing arrangement with the casing, the compression cycle for a compressor can begin. The lobes then move around in the casing and compress the working fluid. The cavity C2 expands to intake a fresh charge of the working fluid. For a motor, the breaking of the seals between the lobe tip 15 and the casing ends the expansion/exhaust cycle.

Figure 7:
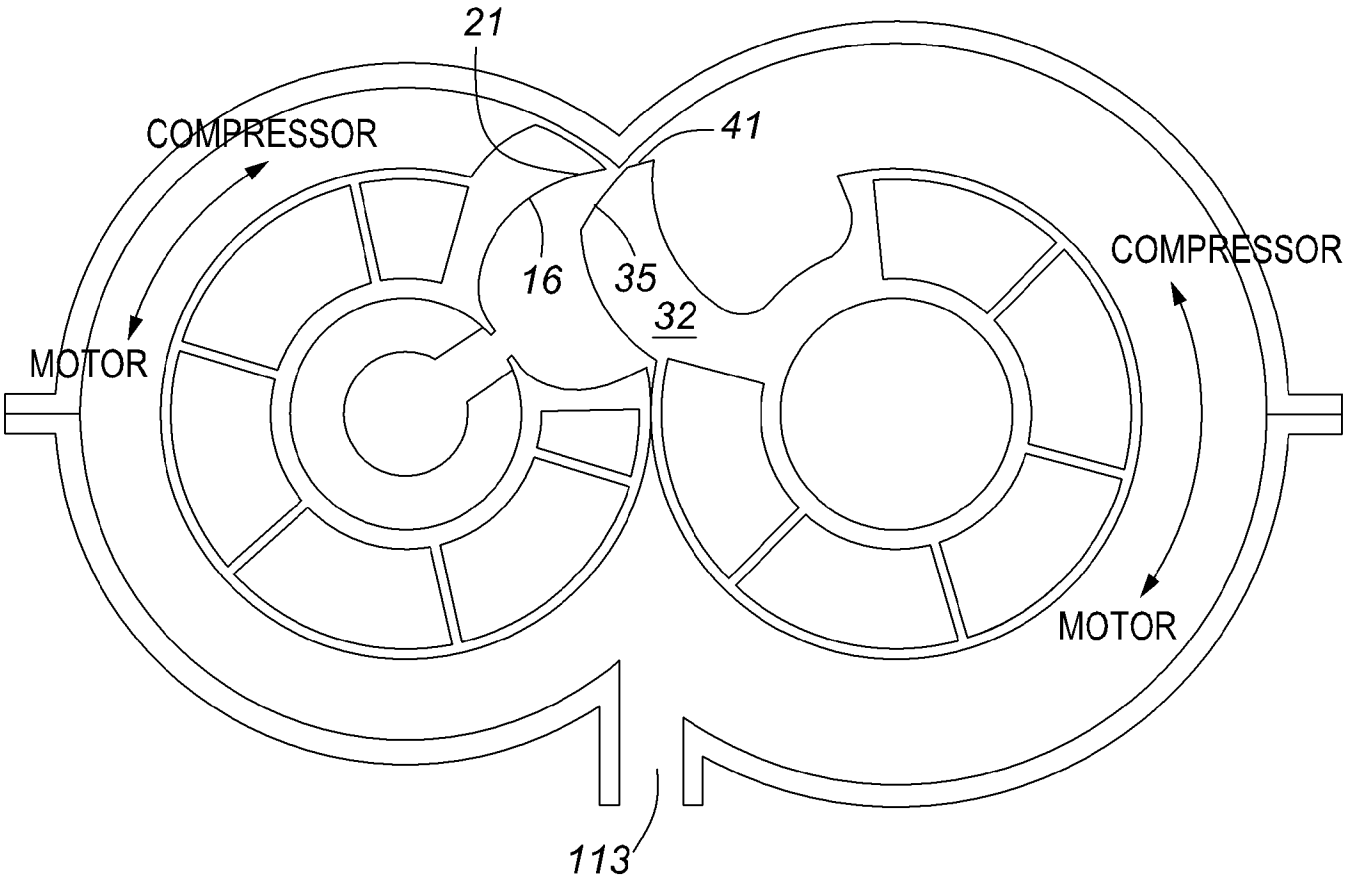
FIG. 7 Illustrates the position of the rotors at the transition point.

FIG. 7 shows an example of the position of the two rotors at the transition of the seal on lobe 32 from surface 35 and the casing to trimmed tip 41 and the sliding contact surface 16. At the instant of transition the only barrier between the high and the low pressure regions is the relationship between the pointed tip 21 and the corner of the trimmed tip 41. In practice, depending for example upon tolerances during manufacture, there might possibly be a gap for a very small angular range of motion, but it is at times desirable to minimize that gap and also the angular range where it occurs. At normal operating speeds the time when the gap would be open is preferably very short so that the amount of leakage is small or negligible.

Figure 8:
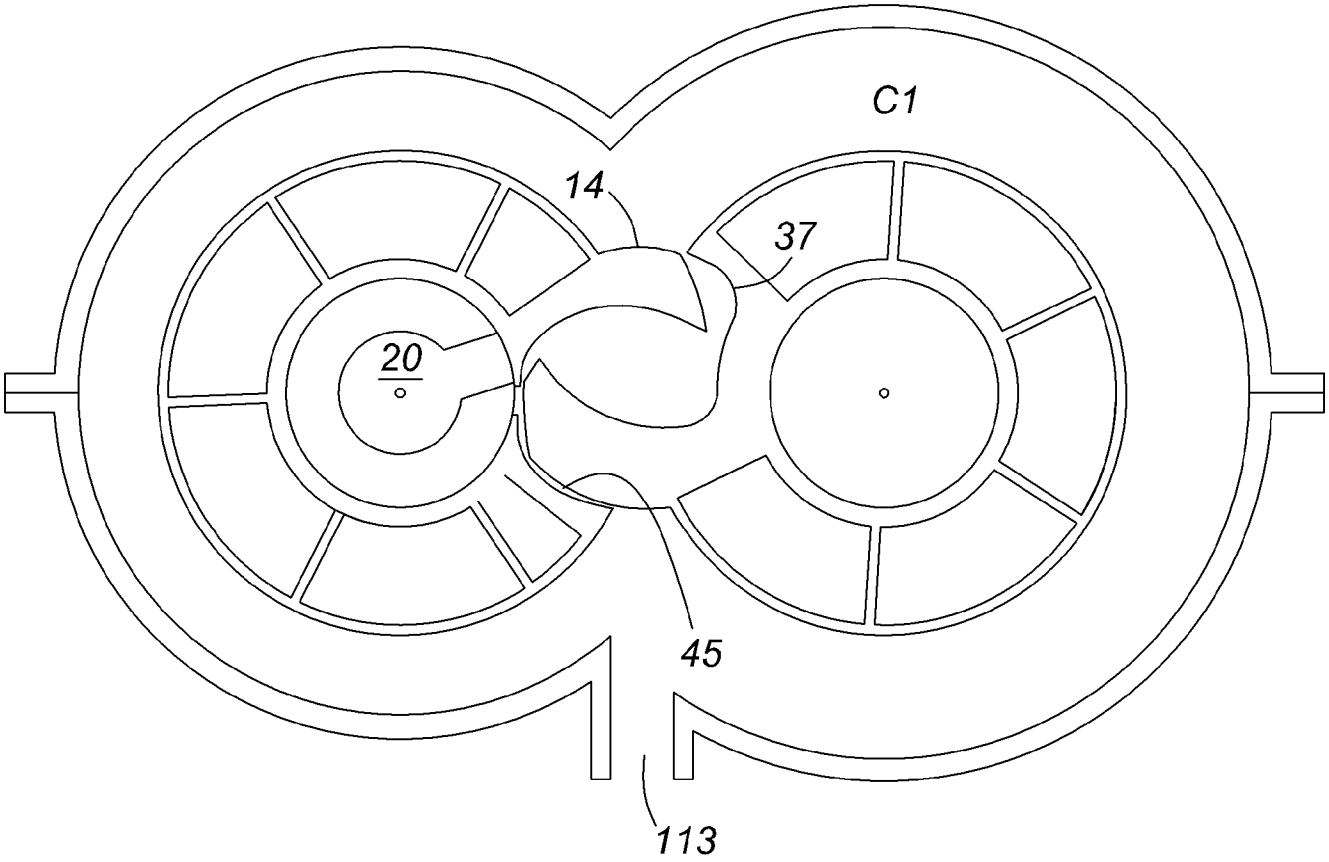
FIG. 8 Illustrates the position of the rotors at the end of the compression cycle for a compressor or the start of the expansion cycle for a motor.

FIG. 8 shows an example of the position of the two rotors at the end of the compression, or the start of the expansion cycle. The cavity C1 is now fully open. There is a small dead volume 45 in the closed cavity that exists in pit 13. Further, the interaction between surfaces 14 and 37 does not necessarily need to resist fluid pressure hence sealing is less important at this point.

Figure 9:
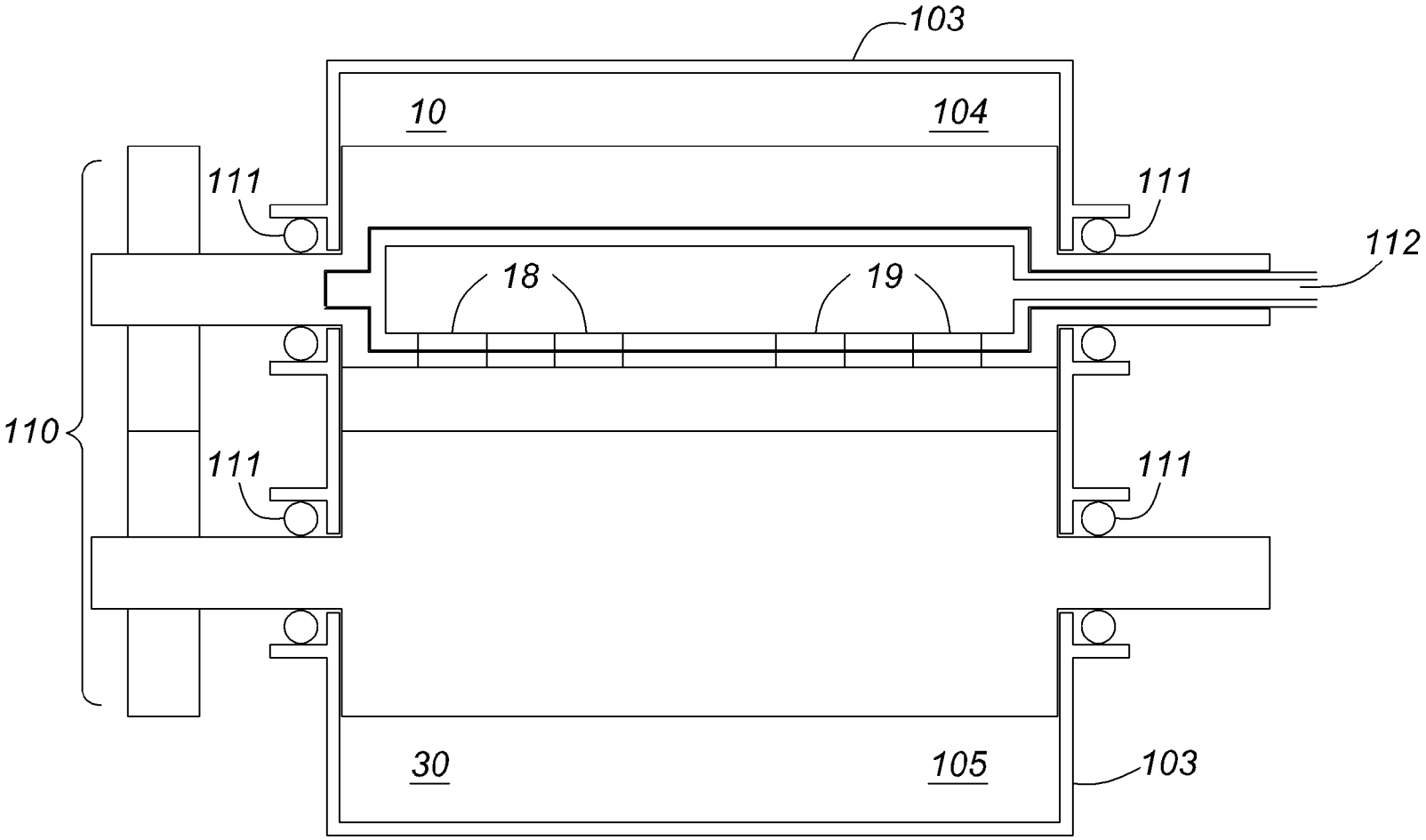
FIG. 9 illustrates a side cross-sectional view of one example of a rotary positive displacement machine as disclosed herein.

FIG. 9 schematically illustrates the same rotary positive displacement machine shown in FIG. 5 but with a side, cross-sectional view effectively rotated through 90 degrees compared to the cross-sectional view shown in FIG. 5. FIG. 9 schematically illustrates the timing gear means 110, as well as bearings 111 upon which the rotors rotate. The cross-section shown in FIG. 9 is also suitable to illustrate input/output tube 112 fixed from rotation for flow of fluid under pressure to or from ports 18, 19, as discussed above, which are formed transiently as the rotor 10 rotates about its axis.

At the position of the rotors illustrated in FIG. 5 it will be noted that trimmed tip 41 of rotor 30 forms a close-clearance or sealing relationship with sliding contact surface 16 of rotor 10. During the final stages of the compression cycle or the initial stages of the expansion cycle, the cavity 120 will also be sealed by the close contact and sealing arrangement between the surfaces 17 and 34.

In selected embodiments, the rotary displacement machines described herein and illustrated for example in FIGS. 5 and 9 may be used as rotary expansion or combustion engines. For example, with reference again to FIG. 5 if rotor 30 turns clockwise then the space 120 between lobe 32 and pit 13 of the adjacent rotor will become larger, defined by close-clearance or sealing of the respective lobe tips with the pits of the adjacent rotor. Temporary alignment of ports 18, 19 permits entry into space 120 of fluid under pressure. The pressure of the fluid alone, or facilitated by heat or ignition of the fluid, forces the space 120 to become larger by forcing apart lobes 12, 32 with consequential rotation of rotors 10 and 30. When rotors 10, 30 have rotated sufficiently for lobes 12, 32 to no longer be interengaging or intermeshing, the outermost surfaces of the lobes will form a close-clearance or sealing relationship with the inner surfaces of the respective bores. However, the lobes may continue to be forced apart (with rotation of the rotors) by virtue of continued expansion of fluid between the lobes (i.e. between the involute curve surface 34 of lobe 32 and the sliding contact surface 16 of lobe 12) in the lumen of the casing between hubs 11, 31 and the inner surface of the casing. Fluid around other portions of the lumen of the casing may, as the rotors rotate, be exhausted under lower pressure out of an exhaust port 113, which in FIGS. 5 and 9 is illustrated as being integral with casing 103.

Importantly, as shown in FIG. 5, at the early stage of expansion of space 120, or at the early stage of fluid ignition as would be the case for a rotary combustion engine, the trimmed or blunt-ended configuration of tip 41 of lobe 32 of rotor 30 facilitates in the close-clearance or sealing contacts that define space 120. Thus, in the rotary cycle the initial force of expansion from fluid under pressure in space 120 more efficiently translates into kinetic energy to expand space 120 by forcing apart of the lobes of adjacent rotors, with resulting rotation of the rotors.

Thus, FIGS. 5 and 9 illustrate example embodiments of a rotary, positive displacement machine, with interengaging rotors, adapted to handle a working fluid by rotation of the rotors through rotary cycles, the machine comprising: a casing structure comprising two or more intersecting bores, at least two of which bores have different radial dimensions relative to one another, the casing further including at least one high pressure port for the flow therethrough of working fluid at high pressure, and at least one low pressure port for the flow therethrough of the working fluid at lower pressure; rotors, each mounted for rotation in one of said intersecting bores with axes for rotation substantially parallel with one another, each rotor comprising at least one radially extending lobe having peripheral, radially-extended surfaces which define close-clearance or sealing interfaces with inner surfaces of each bore within which each rotor is mounted for rotation; such that each lobe on each rotor that has lobes having the smaller radial extent when measured from the hub to the farthest extent (when compared with the larger radial extent of each of the lobes of each rotor that is mounted in the other of said bores) mounted in a suitable one of said bores that has a diameter that provides the said clearance and sealing function. (In the simple case where each rotor has one lobe it will be the smaller of the bores.) Each rotor that has lobes that have a larger radial extent when measured from the hub to the farthest extremity may be mounted for rotation in each of the other of said bores that has a diameter such that the inner surface of said bore provides a close clearance or sealing interface with each tip of each lobe on each rotor.

Each rotor also comprises at least one pit into which to receive a lobe of an adjacent rotor during an interengaging portion of each rotary cycle; and timing gear means constraining said rotors to rotate in timed, interengaging relation in said intersecting bores, with adjacent rotors rotating in opposite directions such that the lobes and pits of adjacent rotors interengage as the rotors rotate.

In selected embodiments, the machine is a compressor and the first rotor is a master rotor, the rotation of which is driven by a power source, the working fluid under pressure exiting the machine at the high-pressure port. In other embodiments, the machine is an expansion engine, and the rotation of the rotors is driven by controlled input of working fluid at the high-pressure port.

In selected embodiments each lobe on each rotor that has lobes having the larger radial extent is mounted for rotation in a suitable bore and comprises a convex surface with a profile similar to the inner surface of that bore, and the bore is sized to accommodate a rotor with the lobes(s) having a larger radial extent, thereby to provide a close-clearance or sealing interface when each lobe moves adjacent the inner surface of each bores during a rotation cycle.

In selected embodiments each lobe on the at least one other rotor has a tip that is blunt-ended or 'trimmed' to achieve, when the lobe is moving adjacent a pit of the first rotor during a rotary cycle, a close-clearance or sealing relationship with said pit of the first rotor.

Optionally the high pressure port is located on an end-plate of the casing, or may be formed transiently during each rotary cycle by alignment of an orifice extending through the first rotor from a central portion thereof to a pit thereof, and an orifice in a conduit fixed from rotation and extending co-axially with the first rotor.

Further embodiments may employ two or more rotors with lobes having larger radial extents in appropriately sized bores spaced appropriately from one another about the first rotor (e.g. when the central rotor has more lobes than rotors with which it interengages the minimum angular spacing between the interengaging rotors may be equal to the angular spacing of the lobes on the central rotor). Still further embodiments may employ a rotor with lobes having a greater radial extent as a central rotor in a bore of appropriate size, with two or more rotors comprising lobes with a smaller radial extent in appropriately sized bores spaced appropriately about the rotor comprising lobes having a larger radial extent (when there are more lobes on the said central rotor than other rotors that interengage with it the minimum angular spacing between the interengaging rotors must be equal to the angular spacing between the lobes on the central rotor). To sum up, either type of rotor may have any number of lobe/pit combinations of the same type providing they are arranged equidistantly around the hub of that rotor. It is also possible to interengage either type of rotor with any number of rotors of the other type as long as there are at least as many lobes on the rotor as there are interengaging rotors. The interengaging rotors may all be similar to one another and the interengaging rotors may be spaced in such a manner that the lobes can interengage with the pits on an adjacent mating rotor. The minimum angular distance between any two interengaging rotors should not be less than the angular spacing of the lobes on the centrally placed rotor.

As previously discussed, the rotary displacement machines disclosed herein may alternatively be used as compressors or pumps. With reference once again to FIGS. 5 and 9, port 113 in casing 103 may be used as a suction port to draw fluid into the lumen between the rotors 10, 30 and the casing 103. Driven rotation of the rotors 10, 30 in a direction opposite to that previously described will cause rotation of the rotor 10 in a clockwise direction, with simultaneous rotation of rotor 30 in an anti-clockwise direction. Either or both of the rotors may be driven providing they move simultaneously in opposite directions as described. Rotation of the rotors may cause the respective lobes to move in a close-clearance or sealing relationship with internal surfaces of the casing, thus dividing the lumen between the rotors 10, 30 and the casing 113 into two regions. One region adjacent the suction port (e.g. in the lumen in the casing in the lower part of FIG. 5) expands in size as the rotors turn, drawing or sucking in fluid at a lower pressure from the port 113. In contrast, the other region of the lumen (e.g. the lumen in the casing in the upper part of FIG. 5) is reduced in size as the rotors are driven to rotate, and as the lobes and pits are forced together into an interengaging or intermeshing relationship. The highest pressure of the fluid may be observed in space 120 as the lobe 32 of rotor 30 is forced against pit 13 of rotor 10, which in the embodiment shown in FIG. 5 coincides with the alignment of ports 18, 19 such that the highly pressurized fluid in space 120 is forced under pressure into output tube 20. Thus, the driven rotation of the rotors 10, 30 compresses fluid in the upper portion of the lumen, especially between the lobes and pits of adjacent rotors as they intermesh, and simultaneously draws fluid in from the port 113 ready for compression or pumping in the next rotary cycle. Importantly, at the critical high-pressure end-stage of the fluid compression, the trimmed or blunt-ended tip 41 of lobe 32 of rotor 30 facilitates the close-clearance or sealing contact between lobe 32 and pit 13 of the adjacent rotor 10 defining space 120, thus helping to force the compressed or pressurized fluid through ports 18, 19, whilst reducing leakage or seepage of pressurized fluid from space 120 into other areas of the lumen as the space 120 contracts. Thus the configuration of the rotary displacement machine, and in particular the provision of rotors having lobes with different radial extents, and designed to rotate in appropriately sized bores, may help to improve the overall efficiency and function of the machine as a compressor or fluid pump.

Thus, in selected embodiments there is provided a compressor for a fluid, the compressor comprising a rotary positive displacement machine as described herein, wherein at least one rotor is powered for rotation by a drive means, said timing gear means transferring rotational energy to the other rotor(s) and/or timing the movement of the other rotor(s) relative to the at least one rotor, so that as adjacent rotors rotate a lobe of the rotor with a lobe or lobes having a larger radial extent is forced into a close-clearance or sealing relationship with a concave surface of a pit of the rotor with a lobe or lobes having a smaller radial extent, thereby to cause pressurization or compression of the fluid therebetween. Optionally, the pressurized or compressed fluid therebetween exits the compressor under pressure from the high pressure port. Optionally, the high pressure port may be formed transiently during each rotary cycle by alignment of an orifice extending between a central portion and a pit of the first rotor, and an orifice in an output conduit fixed from rotation and extending co-axially with the first rotor.

Figure 10:
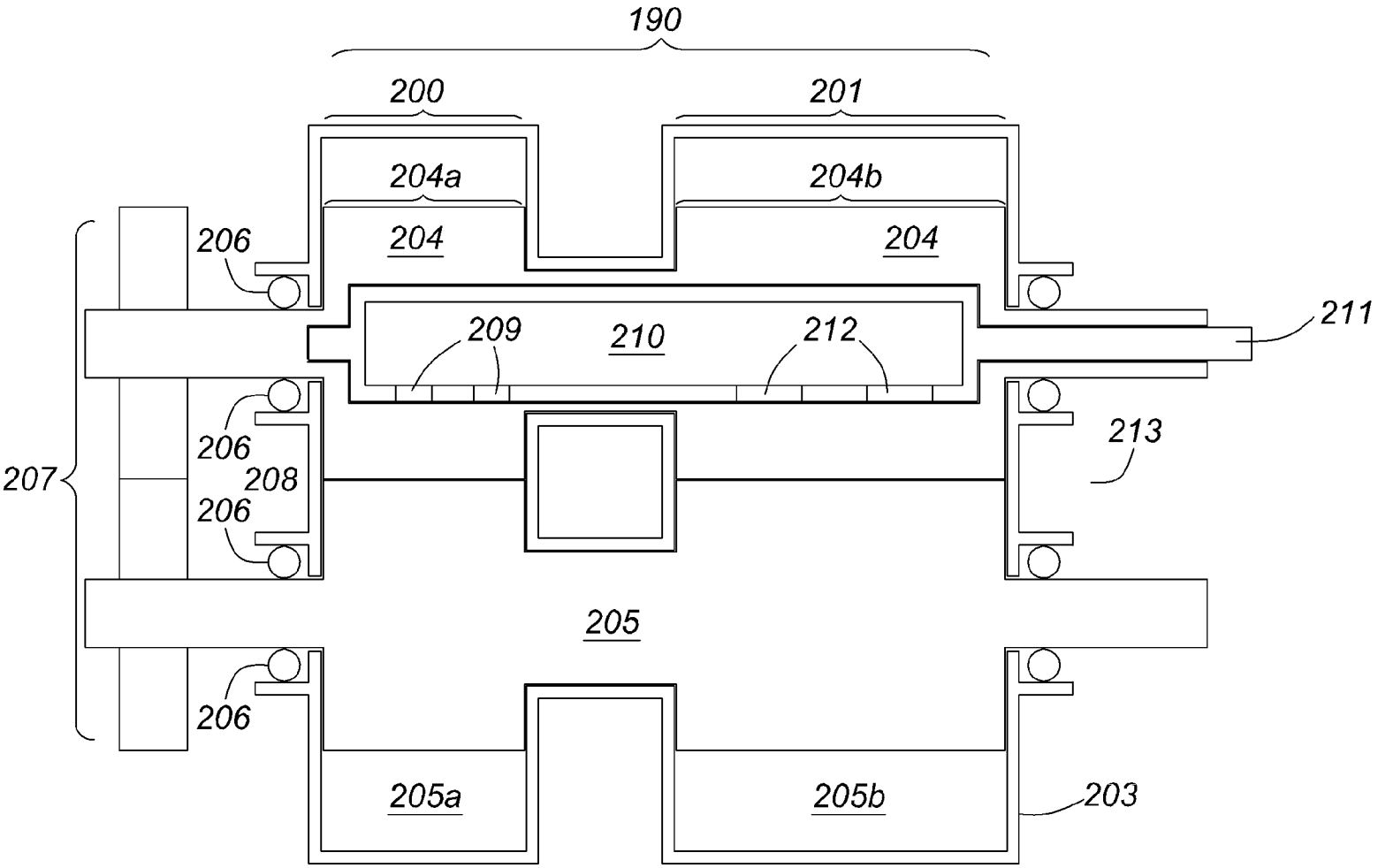
FIG. 10 illustrates a side cross-sectional view of one example of a gas turbine engine as disclosed herein.

Further exemplary embodiments encompass machines comprising both an expansion engine and a compressor of the types discussed above. For example, certain embodiments encompass rotary combustion engines comprising a compressor stage to compress the air, fuel/air or other working fluid prior to its entry into the rotary expansion engine. The compressor and expansion engine stages may be separate in that they are connected only by conduit to direct compressed air, fuel/air or other working fluid from the compressor stage to a fuel input of the expansion engine. In further embodiments, such as that shown in FIG. 10, the rotors of the compressor and expansion engine stages may be physically connected, or may even comprise the same rotors. For example, FIG. 10 schematically illustrates an example positive displacement gas turbine engine shown generally at 190 that employs both a compressor stage 200 and a motor stage 201 in accordance with the teachings herein. The Figure is of a similar cross-section and orientation to that shown in FIG. 9, except that an alternative configuration is shown. The machine comprises a casing 203 at least substantially enclosing adjacent rotors 204 and 205, which themselves comprise compressor portions 204*a*, 205*a* within the compressor stage 200, and expansion portions 204*b*, 205*b* within the motor stage 201 respectively.

Each rotor 204, 205 is mounted for simultaneous, synchronized rotation on bearings 206 by timing gear means 207 such that the pits and lobes of the adjacent rotors interengage or intermesh as previously described with reference to FIGS. 5 and 9. A working fluid such as air or a fuel/air mixture suitable for use in an internal combustion engine, is sucked or drawn into the compressor stage 200 by rotation of the rotors 204, 205 and relative movement of their respective lobes (not shown). Working fluid already in the lumen between the compression portions 204*a*, 205*a* of rotors 204, 205 and casing 203 is compressed between the lobes (not shown) as the rotors rotate. Thus, the working fluid is forced under pressure through transiently aligned compressor ports 209, which upon alignment provide fluid contact between the interior lumen of the compressor stage 200 (or a space between the intermeshing lobes and pits of rotor portions 204*a*, 205*a*) and the lumen of reservoir/delivery tube 210 located within port shaft 211 (which is fixed from rotation). Thus, the reservoir/delivery tube 210 contains working fluid under pressure ready for delivery or insertion or injection into motor stage 201. Upon alignment of motor ports 212 (either at the same time or at a different time to alignment of compressor ports 209), fluid contact is transiently established between the reservoir/delivery tube 210 and the interior lumen of motor stage 201 (or a space between the intermeshing lobes and pits, not shown, of rotor portions 204*b*, 205*b*) such that compressed working fluid is inserted or injected under pressure into the motor stage. If the original working fluid was air or an oxidizer then a fuel may optionally be added during passage through the delivery tube, or during or after injection into the motor stage.

Subsequent ignition of the compressed fuel, either by spontaneous combustion resulting from compression (for example as per a diesel engine) or ignition via an electrical spark (for example as per a gasoline engine) or by some other suitable device, rapidly expands the fuel in the motor stage increasing the pressure and/or the volume, driving apart the lobes (not shown) of motor portions 204*b*, 205*b* of rotors 204, 205 forcing the rotors to turn. Exhaust gases resulting from the ignition of the fuel may exit the machine via exhaust 213 though casing 203.

Thus, in accordance with the embodiment illustrated in FIG. 10, the rotation of the rotors is driven by internal combustion in the motor stage, and a portion of the rotational force imparted by the combustion of the fuel to the rotors is used to cause compression of the incoming fuel in the compressor stage. The configuration of the rotors in accordance with those shown in FIGS. 1, 2, 5, and 9, including the use of different sized adjacent intersecting bores, and corresponding rotor features as herein described, may improve the efficiency of both the compression and motor stages of the machine, particularly at the final stages of compression, and the earliest stages of expansion.

In an alternative version of the above engine, for example when the working fluid is air or some incombustible substance, heat may be added to the working fluid from some external source when it has been compressed and passed through the delivery tube. This added heat may cause an increase in volume and/or pressure of the working fluid that is then injected into the motor. The increased volume may cause an increase in power and hence a net power output from the device after extracting the power to drive the compressor.

Thus, in selected embodiments there is provided an expansion engine comprising a rotary positive displacement machine as described herein, wherein fluid is forced into the machine at high pressure via the high pressure port to force apart the lobes of adjacent rotors thereby to cause rotation of the adjacent rotors in opposite directions. Optionally, the high pressure port extends through the casing. Alternatively, the high pressure port may be formed transiently during each rotary cycle by alignment of an orifice extending between a central portion and a pit of one rotor, and an orifice in an input conduit fixed from rotation and extending to said central portion of the rotor, whereupon each alignment the fluid is injected under pressure into a space between a lobe of an adjacent rotor, and the pit of the first rotor. Further, the lobe(s) of the adjacent rotor may optionally be blunt-ended or 'trimmed' to provide an increased surface area of close-contact or sealing between the end of the lobe(s) and the pit(s) of the first rotor when the fluid is forced into the space.

In any of the expansion engines described herein, the rotors may rotate multiple times by the repeated or continuous injection of fluid under pressure through the high pressure port upon each rotary cycle of the machine. Further, the fluid may be pressurized or expanded prior to entry into the engine by heating.

In still further embodiments, there is provided a gas turbine engine comprising the rotary positive displacement machine as described herein, the high pressure port comprising an injector for a combustible fuel or fuel/air mixture, wherein ignition of the fuel causes rapid heating and expansion and/or an increase in pressure of the fluid within the casing to force the lobes of the adjacent rotors apart, thereby to rotate the adjacent rotors in opposite directions. Optionally, each injector is located to inject fuel into a space formed during a rotary cycle between a pit of the first rotor and a trailing edge of a lobe of at least one other rotor, so that ignition of the fuel causes rapid heating and expansion and/or an increase in pressure of the fluid within the space to force the lobes of the adjacent rotors apart, thereby to rotate the adjacent rotors in opposite directions. Optionally, the lobe(s) of the rotor with lobes having a greater radial extent, are blunt-ended or 'trimmed' to provide an increased surface area of close-contact or sealing between each of said lobe(s) and a pit of an adjacent rotor with lobes having a smaller radial extent when the fuel is injected into the space and ignited.

If required for selected embodiments, the gas turbine engines may further comprise ignition means to ignite the fuel upon or following injection into the casing. Furthermore, the engines may optionally further comprise, as an initial processing stage for the working fluid, a compressor stage comprising a compressor as described herein to pressurize or compress the working fluid prior to injection of the fuel into the casing for ignition, such that pressurized or compressed fluid leaving the compressor via the high pressure port thereof is subsequently injected for ignition to drive the engine. Optionally the rotation of the rotors of the compressor stage may be driven by rotational energy derived from the rotation of the rotors of the engine. Optionally at least one rotor of the compressor stage may be connected to at least one rotor of the engine via a drive shaft.

Regardless of the application or function of the aforementioned rotary displacement machines, such machines and their components may be manufactured with an acceptable degree of tolerance for operation. However, to allow for manufacturing tolerances and other operational variances, it may be desired to incorporate seals or other such devices as integral features of the machines or their components. Examples of optional sealing elements and related devices for use in connection with the rotary positive displacement machines disclosed herein are discussed below.

There are many standard sealing devices known in the art that could be used in accordance with the machines disclosed herein. However, FIGS. 11*a* to 11*h* illustrate some examples of such seals located at critical points and positions, which may be incorporated into the machine components upon manufacture. Such seals are entirely optional and their use will depend upon the precise design, configuration and application of the disclosed machines. For example, such machines and their components include sliding contact surfaces. For hubs and involute surfaces, sealing can be enhanced and allowance for dimensional change can be provided by using flexible materials for those surfaces and corresponding seals. The following sections are intended to suggest some types of active seal for various locations on the machines. However, it should be noted that the examples provided are by no means exhaustive and that the detailed design and selection of materials may need to be assessed according to each specific embodiment.

Motion Control

The concept of motion control refers to any device or feature that would function to control the motion or vibration that may occur on an unrestrained element under centrifugal force. It is suggested that an effective result might be obtained by using some visco elastic material in appropriate places.

Types of Seal

Type 1

Figure 11A:
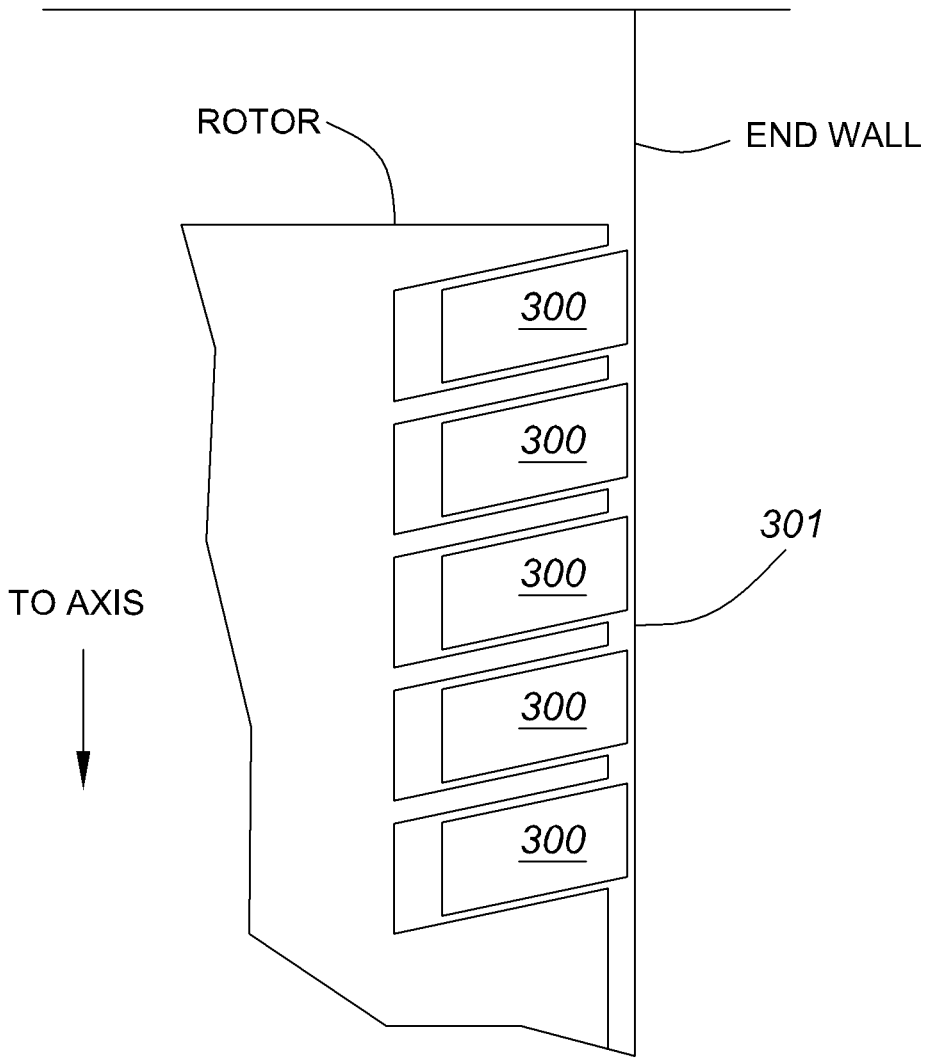
FIGS. 11*a* to 11*h* schematically illustrate various optional sealing elements for use in accordance with the rotary displacement machines described herein.
Figure 11B:
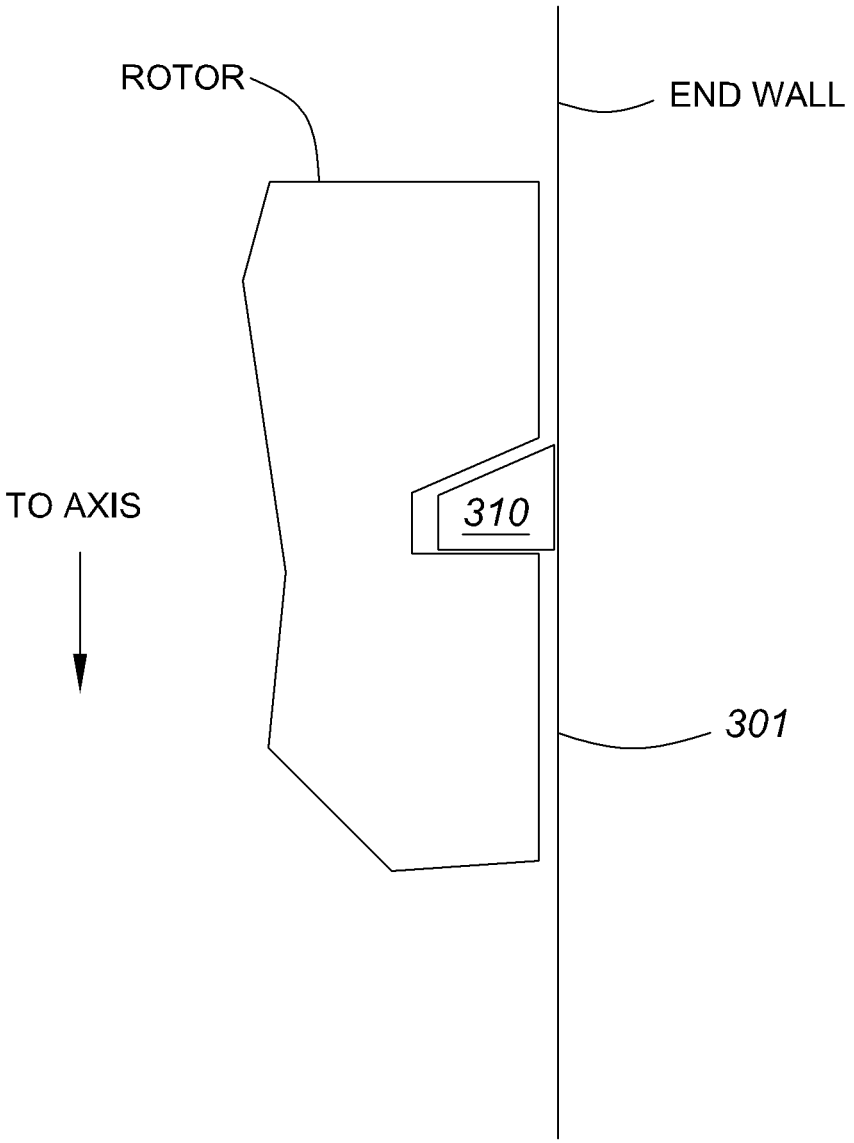

The first types of seal are intended for use against continuous radial surfaces and to provide a seal on an element that has a radial extent. Examples are shown in FIGS. 11*a* and 11*b*. They consist of sealing elements 300 and 310 that are held within chambers that have an outward slope. In operation the elements would be held against the mating surface 301 (e.g. The end wall of the casing) by centrifugal force. That force would be a function of the mass of the elements, the slope of the chambers and the centrifugal force.

Type 2

Figure 11C:
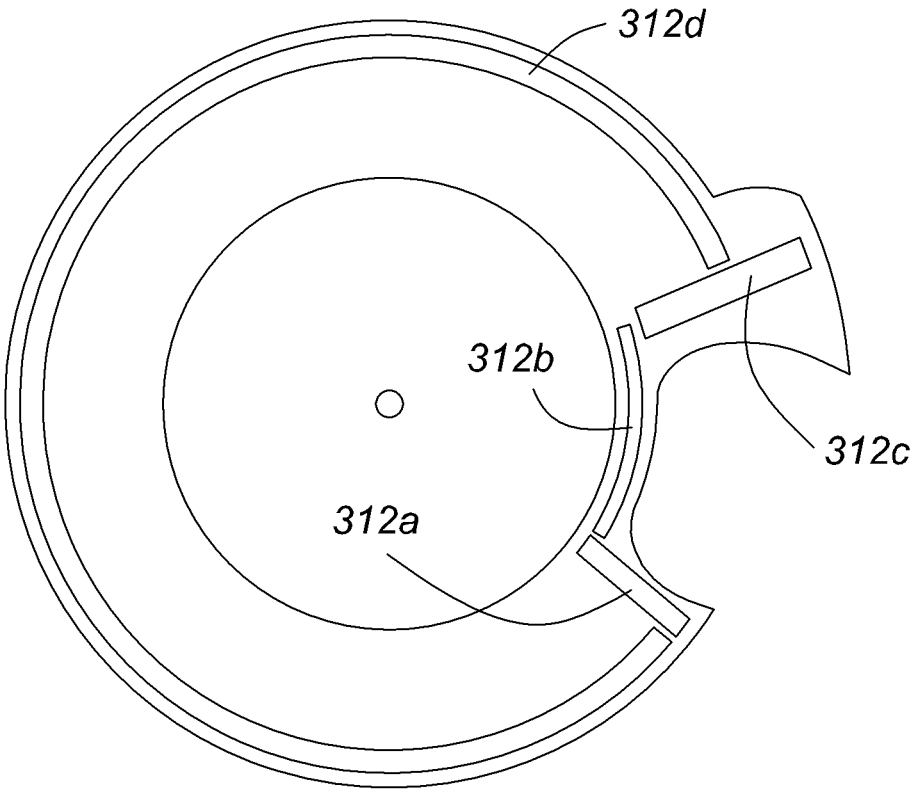
Figure 11D:
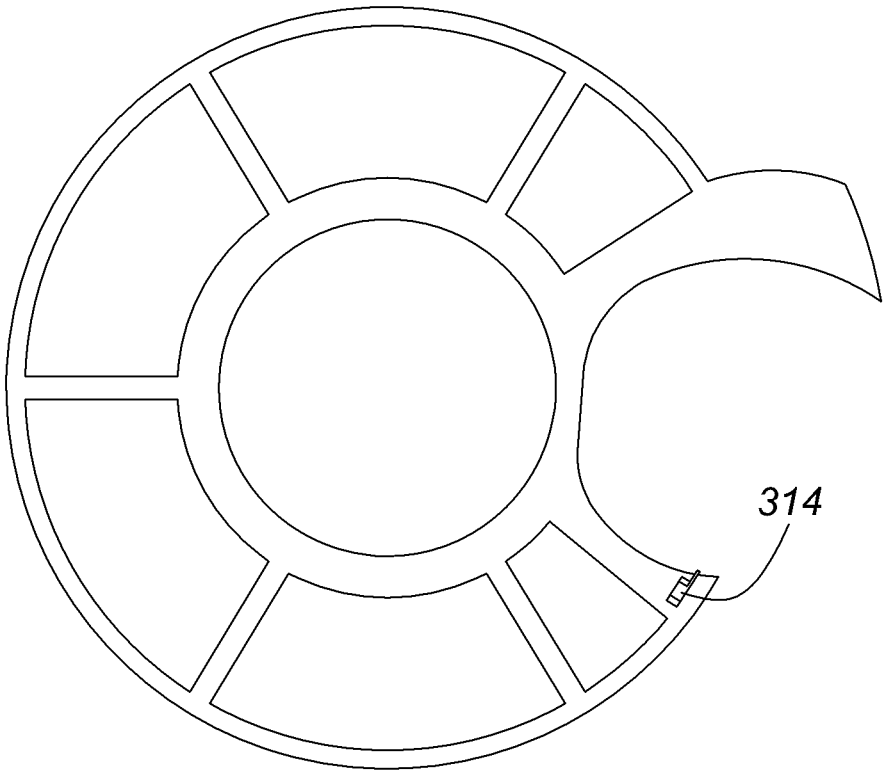

The second type of seal that is illustrated in FIG. 11*b* is one that is suitable for operating against a continuous radial surface and is intended to seal against a radial flow. Semi circular sealing elements 310 are placed in semi circular grooves that have a sloping outer edge and are situated in the ends of the rotor. The centrifugal force will tend to force these sealing elements against the radially oriented sealing surface 301. The sealing pressure will be a function of the mass of the elements, the centrifugal force and the slope of the outer edge of the elements. FIG. 11*c* shows possible locations where these seals can be used. Locations 312*a* ad 312*c* could use the type shown in FIG. 11*a*, while locations 312*b* and 312*d* could use that shown in FIG. 11*b*.

Type 3

The third type of seal is intended to operate against a discontinuous surface that is mainly radial. In this type of seal each sealing element resides in a slot that is mainly normal to a radius as indicated at point 314 in FIG. 11*d*. It may be forced into contact with the sealing surface by means of a spring and has its motion damped. During operation, each sealing element may be locked in place by the centrifugal forces unless the spring applies sufficient force. A motion control device may also be needed.

Type 4

Figure 11E:
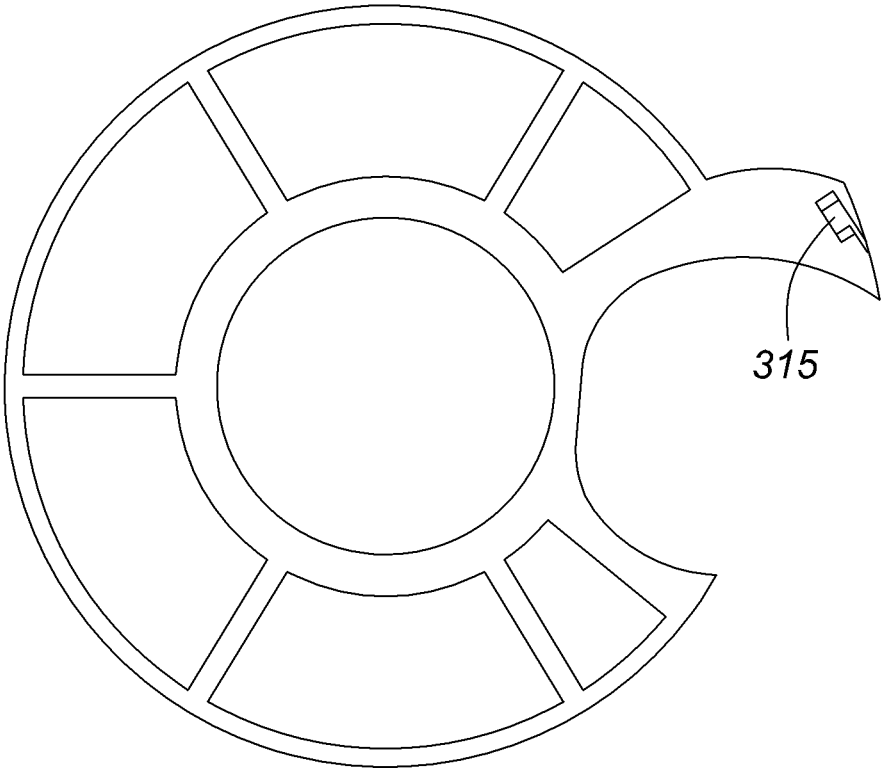

The type four seal is intended for discontinuous surfaces that are mainly circumferential. The example shown in FIG. 11*e* is suitable for a machine that is used as a compressor. For use as a motor, the slope of the sealing element may be reversed. If the sealing element 315 is contained in a slot on the rotating member that is primarily radial in orientation the pressure that will exist between the sealing element and the external surface can be excessively high. That pressure can be significantly reduced if the slot that holds the sealing element has a relatively large tangential component. A motion control device may also be required to ensure that the sealing element would be limited to an acceptable amount of motion during the time that it is not in contact with the external surface. Acceleration ramps may also be required in the area where the sealing element re-establishes contact with the external surface.

Type 5

Figure 11F:
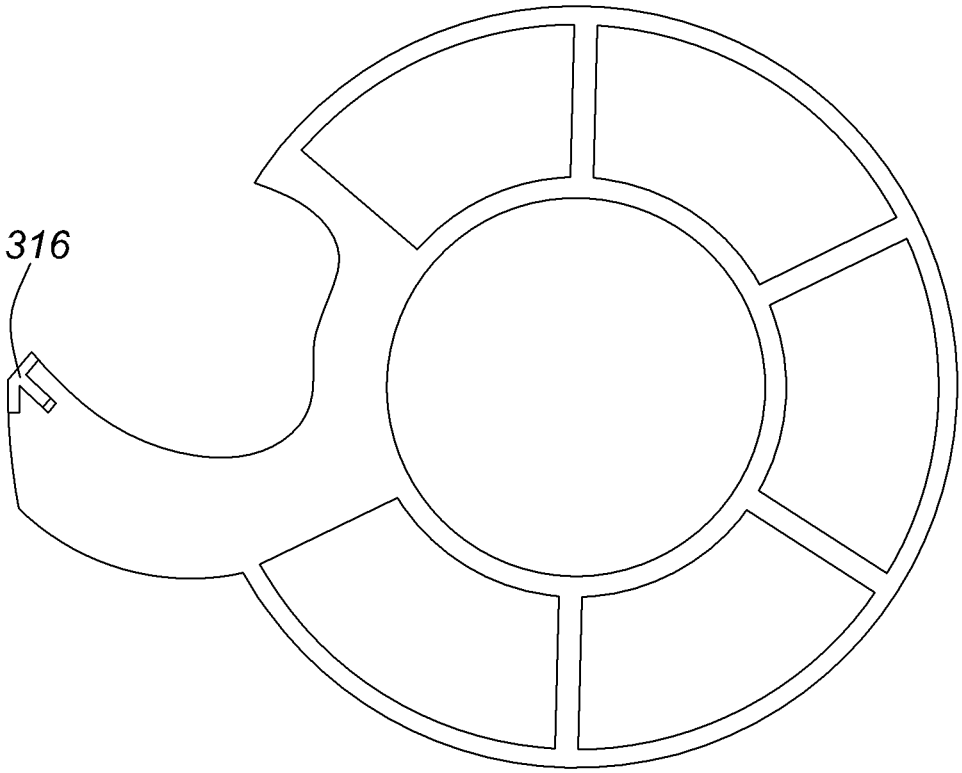

The fifth type of seal, illustrated schematically in FIG. 11*f*, is intended to provide a seal between the lobe and the casing as well as between the trimmed tip and the sliding contact surface at appropriate parts of the cycle, for example when it functions as a compressor. During the part of the cycle when the lobe tip is in close proximity with the casing, the element 316 may be retained by the casing and then it may be retained by the sliding surface. The sealing element will move within a slot in the lobe tip. When the sealing element is no longer in contact with any surface it will tend to move outwards and this motion may be controlled. The use of some form of ramp is at times preferred when the seal next contacts the casing.

Type 6

Figure 11G:
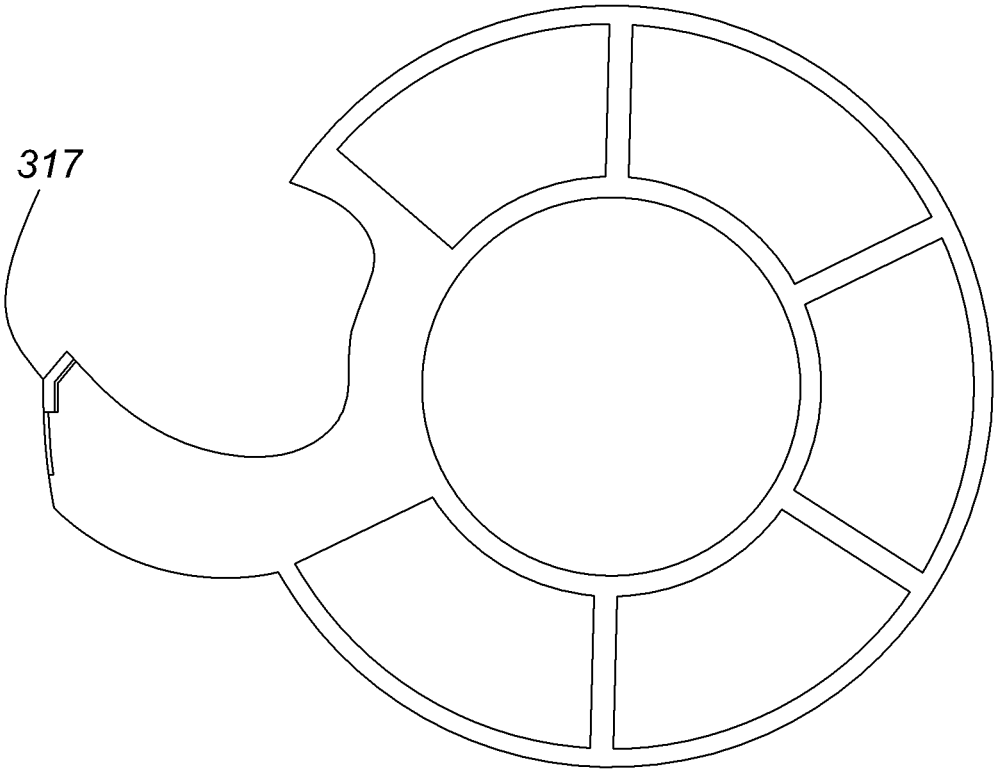

The sixth type of seal, illustrated schematically in FIG. 11*g* at 317, is intended to provide the same function as that shown in FIG. 11*f* for a motor. On this version the sealing element is attached to the lobe by a flexure. The motion of the element may be controlled when it is not in contact with any surface.

Type 7

Figure 11H:
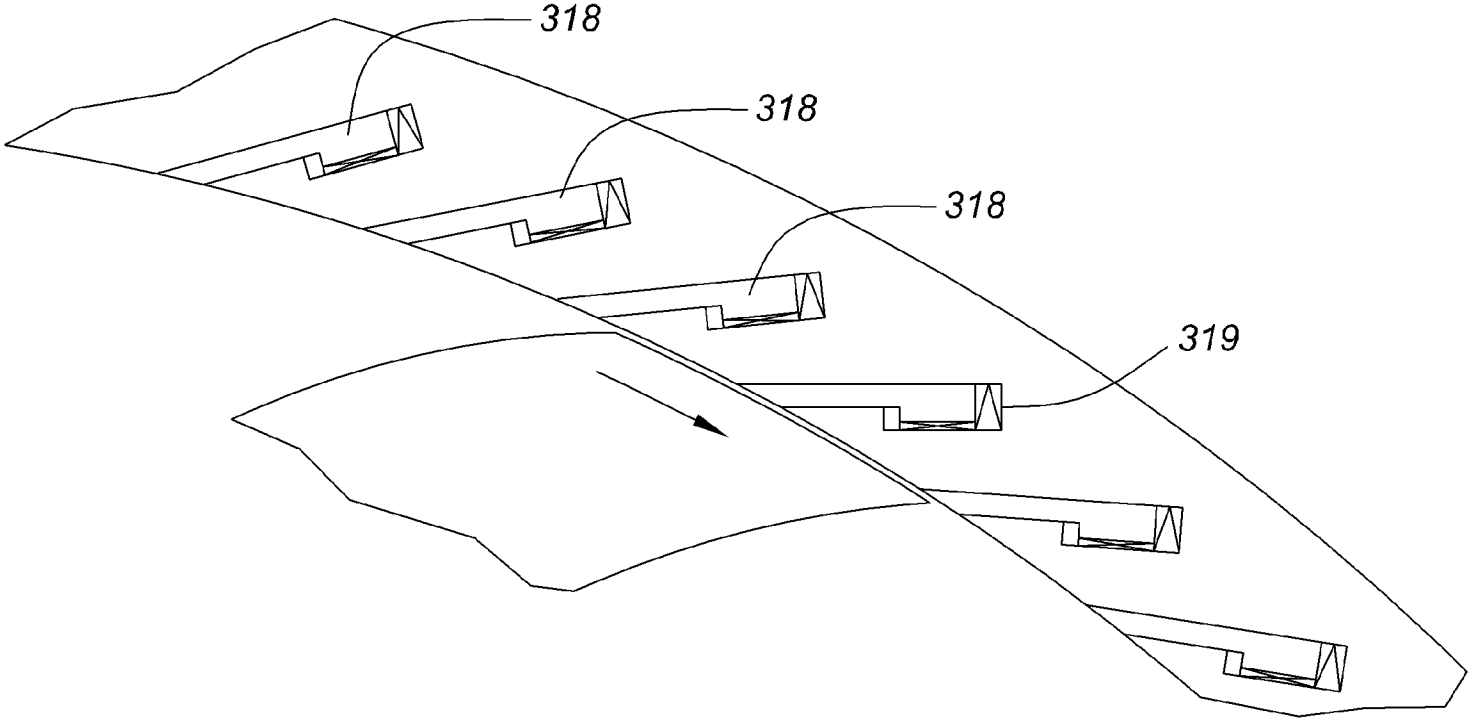

FIG. 11*h* illustrates yet another example sealing element 318 protruding from an inner surface of a bore to assist sealing with an outer surface of a lobe during sliding contact therewith. Biasing means 319 may also be present to help bias each element 318 to protrude for sealing. This type of seal requires careful design to ensure that it functions correctly.

Whilst selected embodiments have been described in relation to various rotors, rotary displacement machines, compressors, pumps, expansion engines, and internal combustion engines, the invention is not limited to those embodiments and still further embodiments may be encompassed within the scope of the appended claims.

The invention claimed is:

1. A gas turbine engine comprising a rotary positive displacement machine with interengaging rotors, adapted to handle a working fluid by rotation of the rotors through rotary cycles, the machine comprising:

a casing structure comprising two or more intersecting bores, at least two of which bores have different radial dimensions relative to one another, the casing further including at least one high pressure port for the flow therethrough of working fluid at high pressure, and at least one low pressure port for the flow therethrough of the working fluid at lower pressure;

rotors, each mounted for rotation in one of said intersecting bores with axes for rotation substantially parallel with one another, each rotor comprising at least one radially extending lobe having peripheral, radially-extended surfaces which define close-clearance or sealing interfaces with inner surfaces of each bore within which each rotor is mounted for rotation;

such that each lobe on each rotor mounted in one size of said bores has lobes that have a smaller radial extent measured from the hub of its respective rotor to a farthest extremity of the lobe, compared to a larger radial extent of each lobe on each rotor mounted in the other size of said bores, thus to provide said close-clearance or sealing interfaces, each rotor also comprising at least one pit into which to receive a lobe of an adjacent rotor during an interengaging portion of each rotary cycle; and timing gear means constraining said rotors to rotate in timed, interengaging relation in said intersecting bores, with adjacent rotors rotating in opposite directions such that the lobes and pits of adjacent rotors interengage as the rotors rotate, wherein the high pressure port comprises an injector for injecting a combustable fuel or fuel/air mixture, into the engine wherein ignition of the injected fuel causes rapid heating with an increase in volume and/or pressure of the fluid within the casing to force the lobes of adjacent rotors apart, thereby to turn adjacent rotors in opposite directions.

2. The gas turbine engine of claim 1, wherein each injector is located to inject fuel into a space formed during a rotary cycle between a pit of a rotor with lobes that have a smaller radial extent, and a trailing edge of a lobe of an adjacent rotor with lobes having a larger radial extent, so that ignition of the injected fuel causes rapid heating with an increase in volume and/or pressure of the fluid within the space to force the lobes of the adjacent rotors apart, thereby to turn the adjacent rotors in opposite directions.

3. The gas turbine engine of claim 2, wherein the lobe(s) of each rotor that has lobes with a larger radial extent are blunt-ended or 'trimmed' to provide an increased surface area of close-contact or sealing between each of said lobe(s), and a pit of an adjacent rotor when the fuel is injected into the space and ignited.

4. The gas turbine engine of claim 1, further comprising ignition means to ignite the fuel upon or following injection into the casing.

5. The gas turbine engine of claim 1, further comprising, as an initial processing stage for the fuel, a compressor stage comprising a compressor to pressurize or compress the fuel prior to injection of the fuel into the casing for ignition, such that pressurized or compressed fluid leaving the compressor via the high pressure port thereof is subsequently injected for ignition to drive the engine.

6. The gas turbine engine of claim 5, wherein the rotation of the rotors of the compressor stage is driven by rotational energy derived from the rotation of the rotors of the engine.

7. The gas turbine engine of claim 6, wherein at least one rotor of the compressor stage is connected to at least one rotor of the engine via a drive shaft.

8. A gas turbine engine comprising a rotary positive displacement machine with interengaging rotors, adapted to handle a working fluid by rotation of the rotors through rotary cycles, the machine comprising:

a casing structure comprising two or more intersecting bores, at least two of which bores have different radial dimensions relative to one another, the casing further including at least one high pressure port for the flow therethrough of working fluid at high pressure, and at least one low pressure port for the flow therethrough of the working fluid at lower pressure;

rotors, each mounted for rotation in one of said intersecting bores with axes for rotation substantially parallel with one another, each rotor comprising at least one radially extending lobe having peripheral, radially-extended surfaces which define close-clearance or sealing interfaces with inner surfaces of each bore within which each rotor is mounted for rotation;

such that each lobe on each rotor mounted in one size of said bores has lobes that have a smaller radial extent measured from the hub of its respective rotor to a farthest extremity of the lobe, compared to a larger radial extent of each lobe on each rotor mounted in the other size of said bores, thus to provide said close-clearance or sealing interfaces, each rotor also comprising at least one pit into which to receive a lobe of an adjacent rotor during an interengaging portion of each rotary cycle; and timing gear means constraining said rotors to rotate in timed, interengaging relation in said intersecting bores, with adjacent rotors rotating in opposite directions such that the lobes and pits of adjacent rotors interengage as the rotors rotate, wherein the gas turbine engine is connected to a compressor comprising another rotary positive displacement machine, and wherein the compressed working fluid from the compressor is heated and then fed or injected into the engine for ignition.

* * * * *